US011420446B2

(12) United States Patent
Horade

(10) Patent No.: US 11,420,446 B2
(45) Date of Patent: Aug. 23, 2022

(54) LIQUID DISCHARGE DEVICE

(71) Applicant: BROTHER KOGYO KABUSHIKI KAISHA, Nagoya (JP)

(72) Inventor: Kenta Horade, Toukai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/940,761

(22) Filed: Jul. 28, 2020

(65) Prior Publication Data

US 2020/0353753 A1 Nov. 12, 2020

Related U.S. Application Data

(62) Division of application No. 16/227,151, filed on Dec. 20, 2018, now Pat. No. 10,759,180.

(30) Foreign Application Priority Data

Dec. 26, 2017 (JP) ..... JP2017-249067

(51) Int. Cl.
*B41J 2/165* (2006.01)
*B41J 2/175* (2006.01)
*B41J 29/13* (2006.01)

(52) U.S. Cl.
CPC ..... *B41J 2/17566* (2013.01); *B41J 2/16517* (2013.01); *B41J 2/1752* (2013.01); (Continued)

(58) Field of Classification Search
CPC .... B41J 2/165; B41J 2/16517; B41J 2/16512; B41J 2/16526; B41J 2002/16573; B41J 2/1707
See application file for complete search history.

(56) References Cited

U.S. PATENT DOCUMENTS 9,381,761 B2 * 7/2016 Takata ..... B41J 2/17566
2005/0068386 A1 3/2005 Hatasa et al.
(Continued)

FOREIGN PATENT DOCUMENTS

CN 105856850 A 8/2016
JP 2003-094686 A 4/2003
(Continued)

OTHER PUBLICATIONS

Office Action issued in related U.S. Appl. No. 16/156,159, dated Mar. 2, 2020.
(Continued)

*Primary Examiner* — Julian D Huffman
(74) *Attorney, Agent, or Firm* — Merchant & Gould P.C.

(57) ABSTRACT

A liquid discharge device includes: a tank including a second liquid chamber connectable to a cartridge having a first liquid chamber storing a liquid; a head; and a controller configured to: discharge ink from the head based on a recording instruction; receive a second signal from a liquid level sensor when a position of the liquid level in the second liquid chamber is less than a predetermined position after the ink is discharged based on the recording instruction; after receiving the second signal, determine whether the cartridge is installed in an installation case; based on determining that the cartridge is installed in the installation case after receiving the second signal from the liquid level sensor, accept a maintenance process; and based on receiving the first signal from the liquid level sensor, perform the maintenance process.

11 Claims, 12 Drawing Sheets

(52) U.S. Cl.
CPC ..... *B41J 2/17509* (2013.01); *B41J 2/17513* (2013.01); *B41J 2/17523* (2013.01); *B41J 2/17553* (2013.01); *B41J 2/17596* (2013.01); *B41J 29/13* (2013.01); *B41J 2002/16573* (2013.01); *B41J 2002/17573* (2013.01); *B41J 2002/17576* (2013.01)

(56) References Cited

U.S. PATENT DOCUMENTS

| | | | |
|---|---|---|---|
| 2008/0198207 | A1 | 8/2008 | Katada |
| 2008/0204488 | A1 | 8/2008 | Usui |
| 2008/0231676 | A1 | 9/2008 | Shimizu |
| 2010/0231641 | A1 | 9/2010 | Danzuka |
| 2014/0354719 | A1 | 12/2014 | Yamagata et al. |
| 2016/0016407 | A1 | 1/2016 | Nagase |
| 2016/0052276 | A1 | 2/2016 | Tenkawa |
| 2016/0279962 | A1 | 9/2016 | Ishida et al. |
| 2016/0279963 | A1 | 9/2016 | Koganehira et al. |
| 2017/0190186 | A1 | 7/2017 | Kubota et al. |

FOREIGN PATENT DOCUMENTS

| | | | |
|---|---|---|---|
| JP | 2005-103855 | A | 4/2005 |
| JP | 2006-256005 | A | 9/2006 |
| JP | 2008-213162 | A | 9/2008 |
| JP | 2010-58305 | A | 3/2010 |
| JP | 2014-233858 | A | 12/2014 |
| JP | 2016-112882 | A | 6/2016 |
| JP | 2016-190361 | A | 11/2016 |
| JP | 2017-30183 | A | 2/2017 |

OTHER PUBLICATIONS

Japanese Office Action issued in corresponding Japanese Patent Application No. 2017-249067, dated Feb. 22, 2022.
Japanese Office Action issued in corresponding Japanese Patent Application No. 2017-249067, dated Aug. 31, 2021.

* cited by examiner

LIQUID DISCHARGE DEVICE

CROSS-REFERENCE TO RELATED APPLICATION

This application is a divisional of U.S. patent application Ser. No. 16/227,151, filed Dec. 20, 2018, which claims priority from Japanese Patent Application No. 2017-249067 filed on Dec. 26, 2017, and which applications are incorporated herein by reference. To the extent appropriate, a claim of priority is made to each of the above disclosed applications.

TECHNICAL FIELD

The disclosure relates to a liquid discharge device which discharges a liquid.

BACKGROUND

There has been disclosed an inkjet printer which includes a detachable main tank, a sub tank which stores ink supplied from the installed main tank, and an image recording unit which ejects the ink stored in the sub tank to record an image. The inkjet printer is configured such that the inner spaces of the main tank and the sub tank are open to the air. Therefore, when the main tank is installed in the inkjet printer, the ink moves such that the liquid levels of the ink of the main tank and the sub tank become flush with each other by a difference between the water head of the inner space of the main tank and the water head of the inner space of the sub tank (hereinafter, referred to as "water head difference").

SUMMARY

A liquid discharge device includes: a tank including a second liquid chamber connectable to a cartridge having a first liquid chamber storing a liquid; a head; and a controller configured to: discharge ink from the head based on a recording instruction; receive a second signal from a liquid level sensor when a position of the liquid level in the second liquid chamber is less than a predetermined position after the ink is discharged based on the recording instruction; after receiving the second signal, determine whether the cartridge is installed in an installation case; based on determining that the cartridge is installed in the installation case after receiving the second signal from the liquid level sensor, accept a maintenance process; and based on receiving the first signal from the liquid level sensor, perform the maintenance process.

BRIEF DESCRIPTION OF DRAWINGS

FIGS. 1A and 1B are external perspective views of a printer, in which FIG. 1A illustrates a state where a cover is at a close position, and FIG. 1B illustrates a state where the cover is at an open position;

FIGS. 5A and 5B are diagrams illustrating a structure of a cartridge, in which FIG. 5A is a front perspective view, and FIG. 5B is a vertical cross-sectional view;

DETAILED DESCRIPTION

Figure 1A:
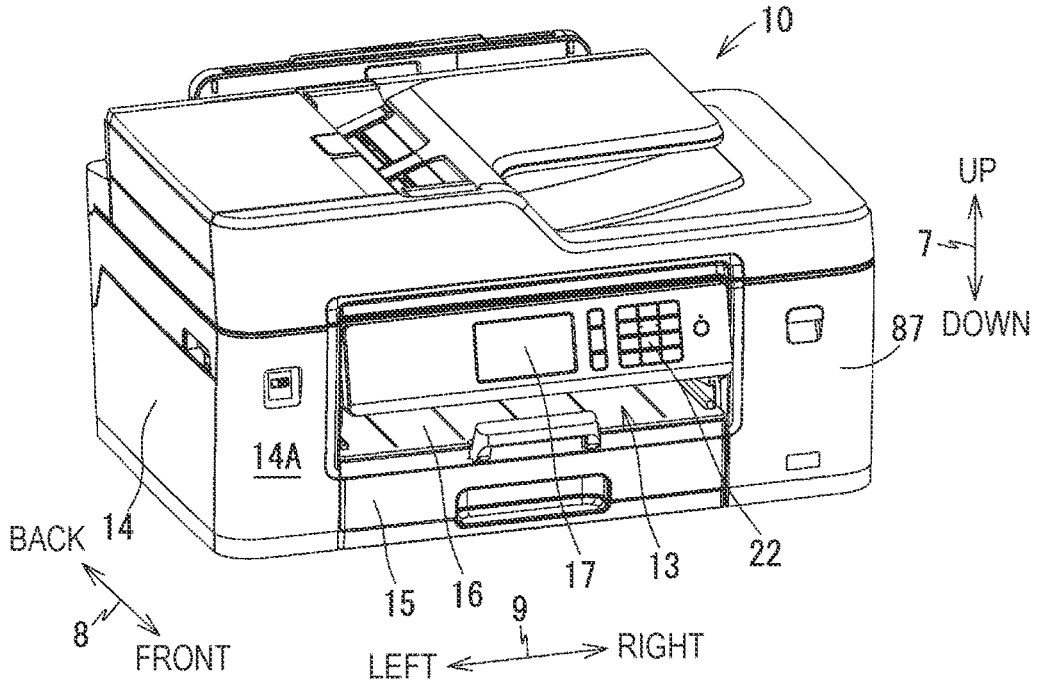

The above-described related-art inkjet printer performs a maintenance process of discharging the ink from the image recording unit by applying a negative or positive pressure to the image recording unit. The maintenance process is a process for the purpose of removing jam or bubbles in a flow path of the image recording unit. For example, the maintenance process is performed based on a user's input, or is performed in a predetermined time interval or periodically after predetermined numbers of sheets are subjected to the image recording.

When the ink of the main tank is consumed, the main tank is exchanged. When the main tank is exchanged, the liquid level of the ink of the sub tank may be the same as the liquid level of the ink of the exchanged main tank. When the main tank is exchanged, and the exchanged main tank becomes empty, the liquid level of the ink of the sub tank is lower than the bottom of a liquid chamber of the exchanged main tank. When the main tank storing an initial filling amount of ink is installed in the inkjet printer, the liquid levels of the ink of the main tank and the sub tank are different in height immediately after the main tank is installed. In other words, the water head difference occurs. The ink flows from the main tank to the sub tank in order to remove the water head difference so as to make the liquid levels of the ink of the main tank and the sub tank equal in height.

The maintenance process may be accepted immediately after the main tank is installed in the inkjet printer. When the maintenance process is performed, the ink is discharged from the sub tank in a state where the liquid level of the ink of the sub tank does not sufficiently rise. If a flow rate of the ink flowing from the sub tank to the image recording unit is larger than the flow rate of the ink flowing from the main tank to the sub tank, the liquid level of the ink of the sub tank is lowered. As a result, there is a concern that the air may enter from the sub tank toward the image recording unit. Therefore, it is considered that the maintenance process is on standby immediately after the main tank is exchanged until the liquid levels of the ink of the main tank and the sub tank become flush with each other even though the maintenance process is accepted.

However, if the main tank is installed in the inkjet printer and the time until the maintenance process is performed after the maintenance process is accepted is long, there is a concern about the following defects. In other words, the user may misunderstand that there occurs a defect in taking-over and performing the maintenance process. The user needs to wait for a long time until the inkjet printer is operable after the maintenance process.

The disclosure has been made in view of the above problems, and illustrative aspects of the disclosure provide a technology that a cartridge is installed in an installation case and a time taken until the maintenance process is performed after taking over the maintenance process is shortened.

Hereinafter, illustrative embodiments of the disclosure will be described. The illustrative embodiments described below are given as merely exemplary, and it is of course that the illustrative embodiments of the disclosure may be appropriately changed within a scope not departing the spirit of the disclosure. An upward and downward direction 7 is defined with reference to a use posture of the printer 10 which is installed horizontally, a forward and backward direction 8 is defined in which a surface with an opening 13 of the printer 10 formed is a front surface, and a right and left direction 9 is defined when the printer 10 is viewed from the front surface. In each illustrative embodiment, in the use posture, the upward and downward direction 7 corresponds to a vertical direction, and the forward and backward direction 8 and the right and left direction 9 correspond to a horizontal direction. The forward and backward direction 8 and the right and left direction 9 are orthogonal.

First Illustrative Embodiment (Outline of Printer)

The printer 10 according to this illustrative embodiment is an example of a liquid discharge device which records an image in a sheet in an inkjet recording method. The printer 10 includes a housing 14 of a substantially rectangular shape. The printer 10 may be a so-called "multifunction peripheral" which has a facsimile function, a scan function, and a copy function.

Figure 1B:
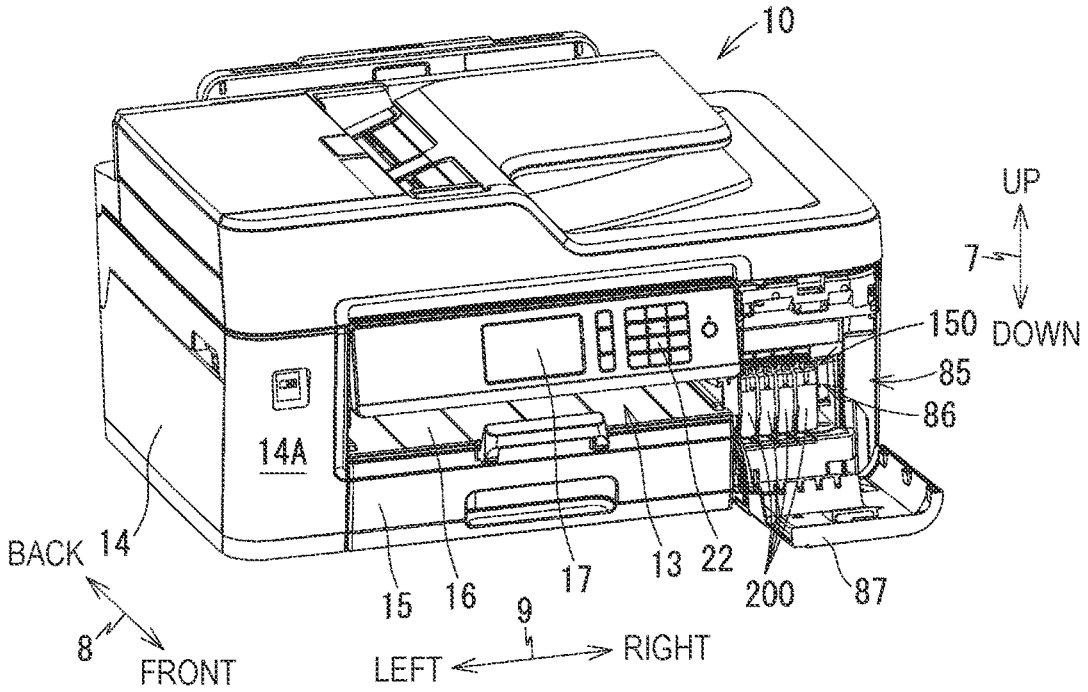
Figure 2:
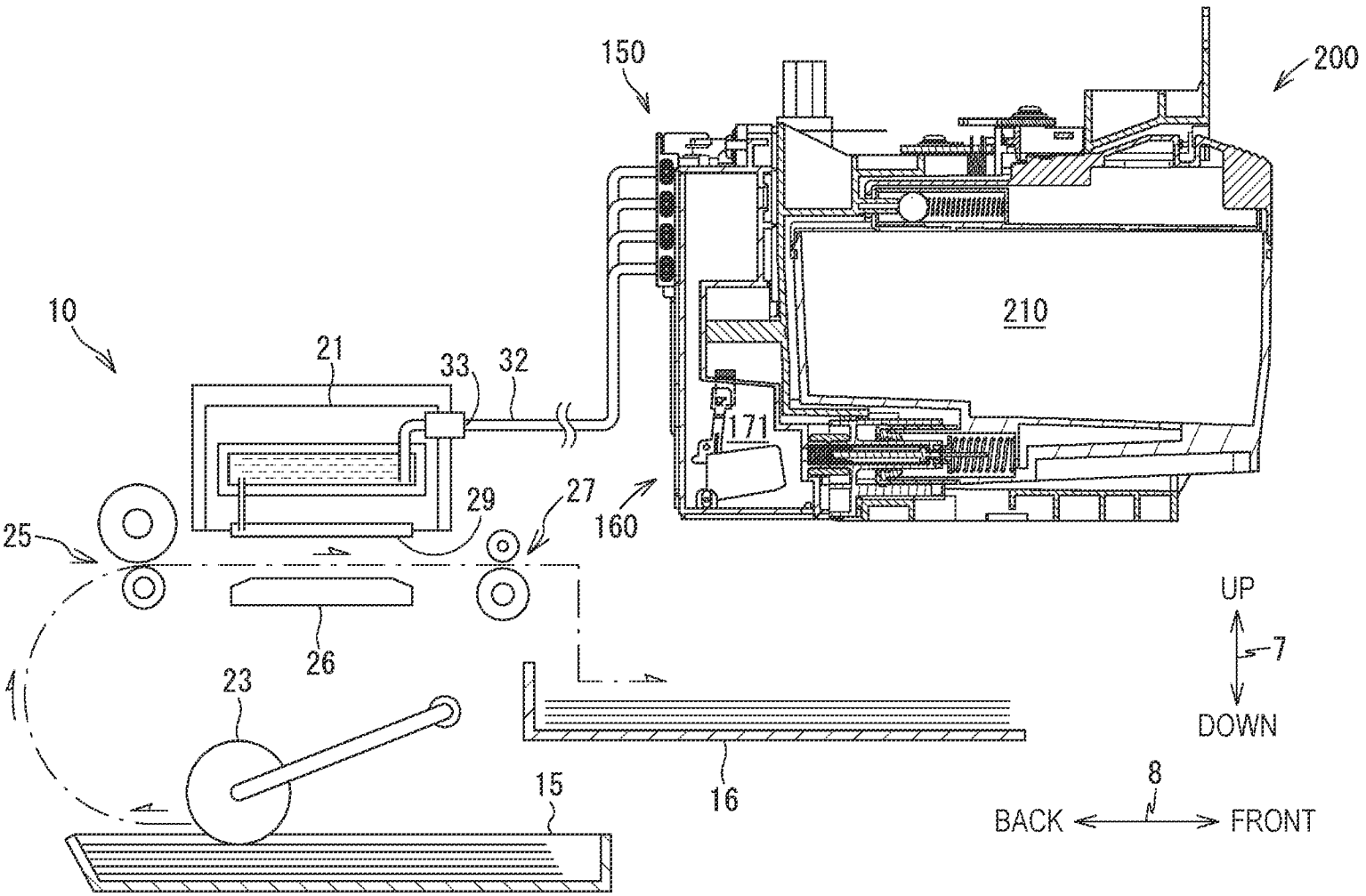
FIG. 2 is a cross-sectional view schematically illustrating an inner structure of the printer.
Figure 3:
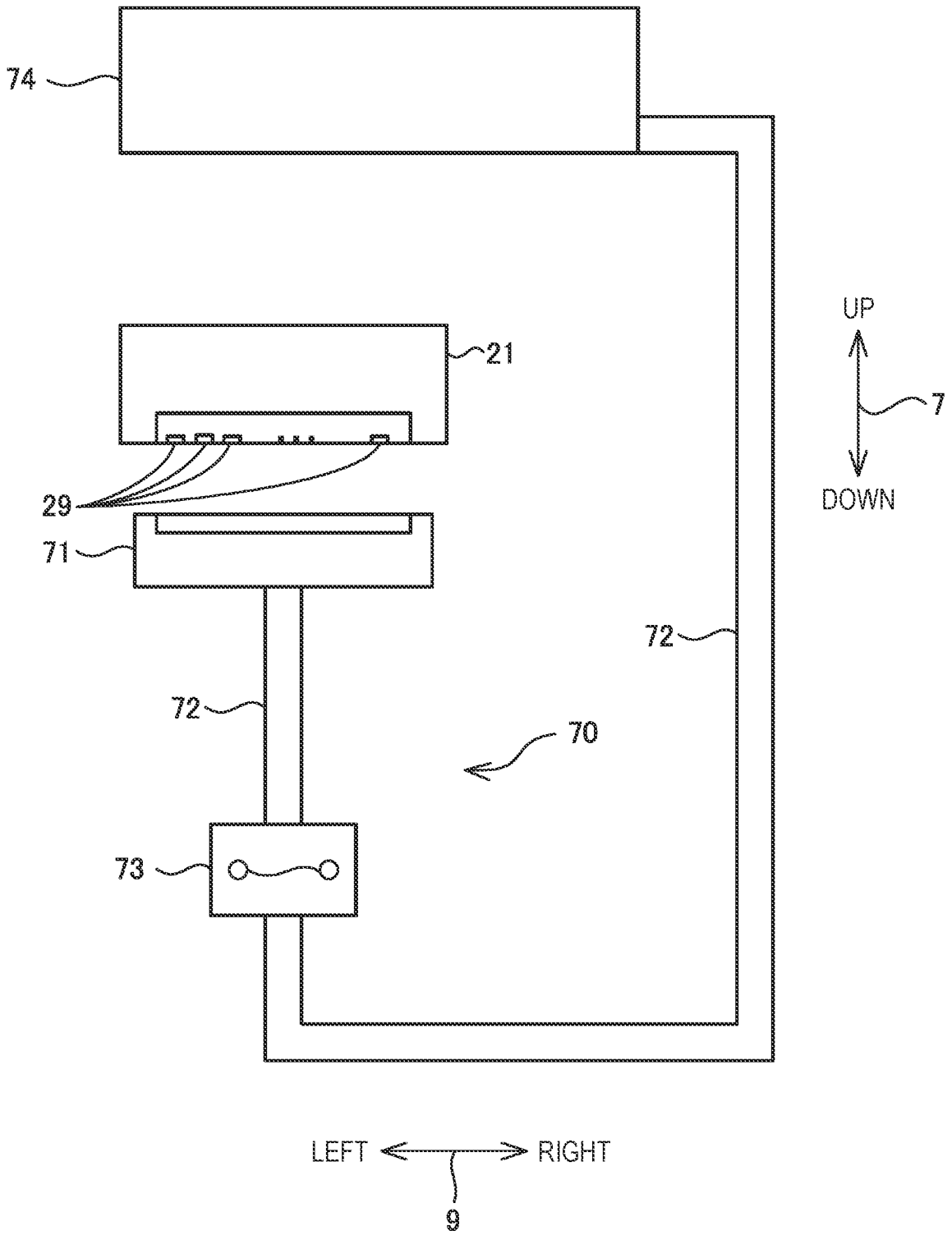
FIG. 3 is a diagram schematically illustrating a configuration of a maintenance mechanism.

In the housing 14, as illustrated in FIGS. 1 to 3, there are positioned a feed tray 15, a feed roller 23, a conveyance roller 25, a head 21 which includes the plurality of nozzles 29, a platen 26 which faces the head 21, a discharge roller 27, a discharge tray 16, an installation case 150 to which the cartridge 200 is detachably attached, a tube 32 which connects the head 21 and the cartridge 200 installed in the installation case 150, and the maintenance mechanism 70.

The printer 10 drives the feed roller 23 and the conveyance roller 25 to convey the sheet supported by the feed tray 15 up to the position of the platen 26. Next, the printer 10 ejects the ink supplied from the cartridge 200 installed in the installation case 150 through the tube 32 to the head 21 through the nozzle 29. With this configuration, the ink is placed in the sheet supported by the platen 26 to record an image on the sheet. The printer 10 drives the discharge roller 27 to discharge the sheet with the recorded image to the discharge tray 16.

More specifically, the head 21 may be mounted in a carriage which reciprocates in a main scanning direction intersecting with a conveyance direction of the sheet by the conveyance roller 25. The printer 10 may eject the ink to the head 21 through the nozzle 29 in process of moving the carriage from one to the other side in the main scanning direction. With this configuration, the image is recorded in a partial region of the sheet facing the head 21. Next, the printer 10 may convey the sheet to the conveyance roller 25 such that a region to be recorded with an image faces the head 21. The image is recorded in one sheet by repeating these processes.

In the below description, the discharging of ink from the nozzle 29 of the head 21 in the image recording is called "ejecting". On the other hand, the discharging of ink from the nozzle 29 of the head 21 in purging is not called "ejecting". However, the "ejecting" is a concept contained in the "discharging".

(Maintenance Mechanism)

Hereinbelow, the maintenance mechanism 70 will be described with reference to FIG. 3. The maintenance mechanism 70 performs maintenance of the head 21.

More specifically, the maintenance mechanism 70 performs the purging operation to absorb the ink and air in the nozzle 29 and foreign matters attached in the nozzle surface. The ink and air in the nozzle 29 and the foreign matters attached in the nozzle surface are referred to as the ink below. The ink absorbed and removed by the maintenance mechanism 70 is stored in a waste liquid tank 74.

The maintenance mechanism 70 is at a position (hereinafter, referred to also as "home position") away from the region of the sheet where the head 21 records the image in one side (right side) in the main scanning direction. The maintenance mechanism 70 includes a cap 71, a tube 72, and a pump 73.

The cap 71 is configured by rubber. The cap 71 is an opposite surface to the head 21 when the head 21 is located at the home position. The tube 72 is used to connect the cap 71 and the waste liquid tank 74. The tube 72 reaches the waste liquid tank 74 from the cap 71 through the pump 73. The pump 73 is, for example, a rotary tube pump. The pump 73 is driven by a motor (not illustrated), and absorbs the ink in the nozzle 29 through the cap 71 and the tube 72, and discharges the ink to the waste liquid tank 74 through the tube 72.

The cap 71 is configured to be movable between a separating position and a coating position by an elevating mechanism (not illustrated).

The cap 71 at the coating position is tightly attached to the nozzle surface of the head 21 at the home position to cover the nozzle surface. In the nozzle surface, the plurality of nozzles 29 are open. On the other hand, the cap 71 at the separating position is separated from the nozzle surface of the head 21 at the home position in the upward and downward direction 7.

(Cover)

As illustrated in FIGS. 1A and 1B, an opening 85 is formed in a front surface 14A of the housing 14 and at the right end in the right and left direction 9. Further, the housing 14 includes the cover 87. The cover 87 is rotatable between a close position (a position illustrated in FIG. 1A) where the opening 85 is closed and an open position (a position illustrated in FIG. 1B) where the opening 85 is open. For example, the cover 87 is supported by the housing 14 to be rotatable about a rotating axial line along the right and left direction 9 near the lower end of the housing 14 in the upward and downward direction 7. The installation case 150 is located in a containing space 86 in the housing 14 such that the space is widened in a deep portion of the opening 85.

(Cover Sensor)

Figure 7:
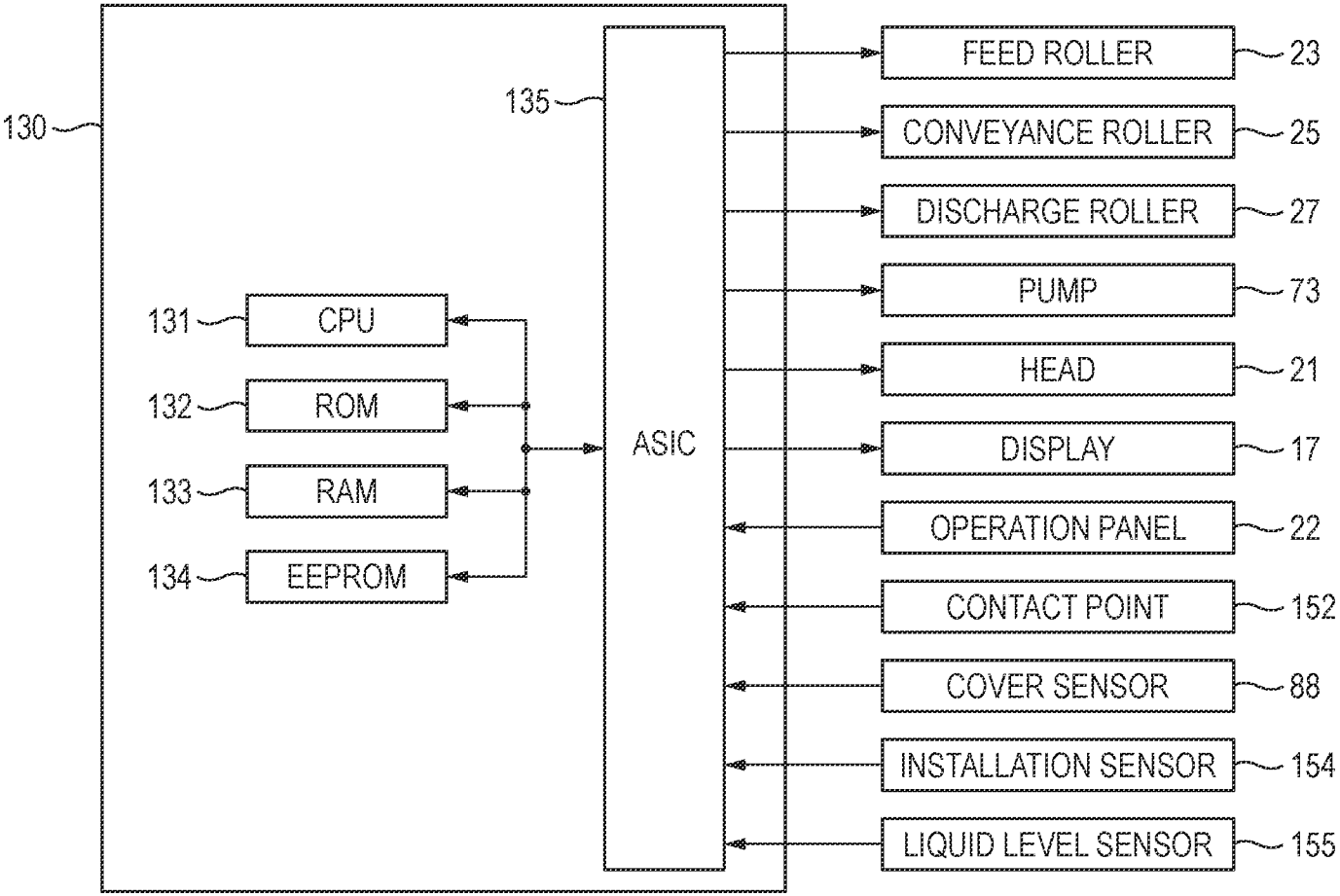
FIG. 7 is a block diagram of the printer.

The printer 10 includes the cover sensor 88 (FIG. 7). The cover sensor 88 may be a mechanical sensor such as a switch which operates according to connecting/disconnecting of the cover 87, or may be an optical sensor which blocks/transmits light according to the position of the cover 87. The cover sensor 88 outputs a signal according to the position of the cover 87 to a controller 130. More specifically, the cover sensor 88 outputs a low level signal to the controller 130 as the cover 87 is located at the close position. On the other hand, the cover sensor 88 outputs a high level signal having a signal strength higher than that of the low level signal to the controller 130 as the cover 87 is located at a position other than the close position. In other words, the cover sensor 88 outputs the high level signal to the controller 130 as the cover 87 is located at the open position.

(Installation Case)

Figure 4:
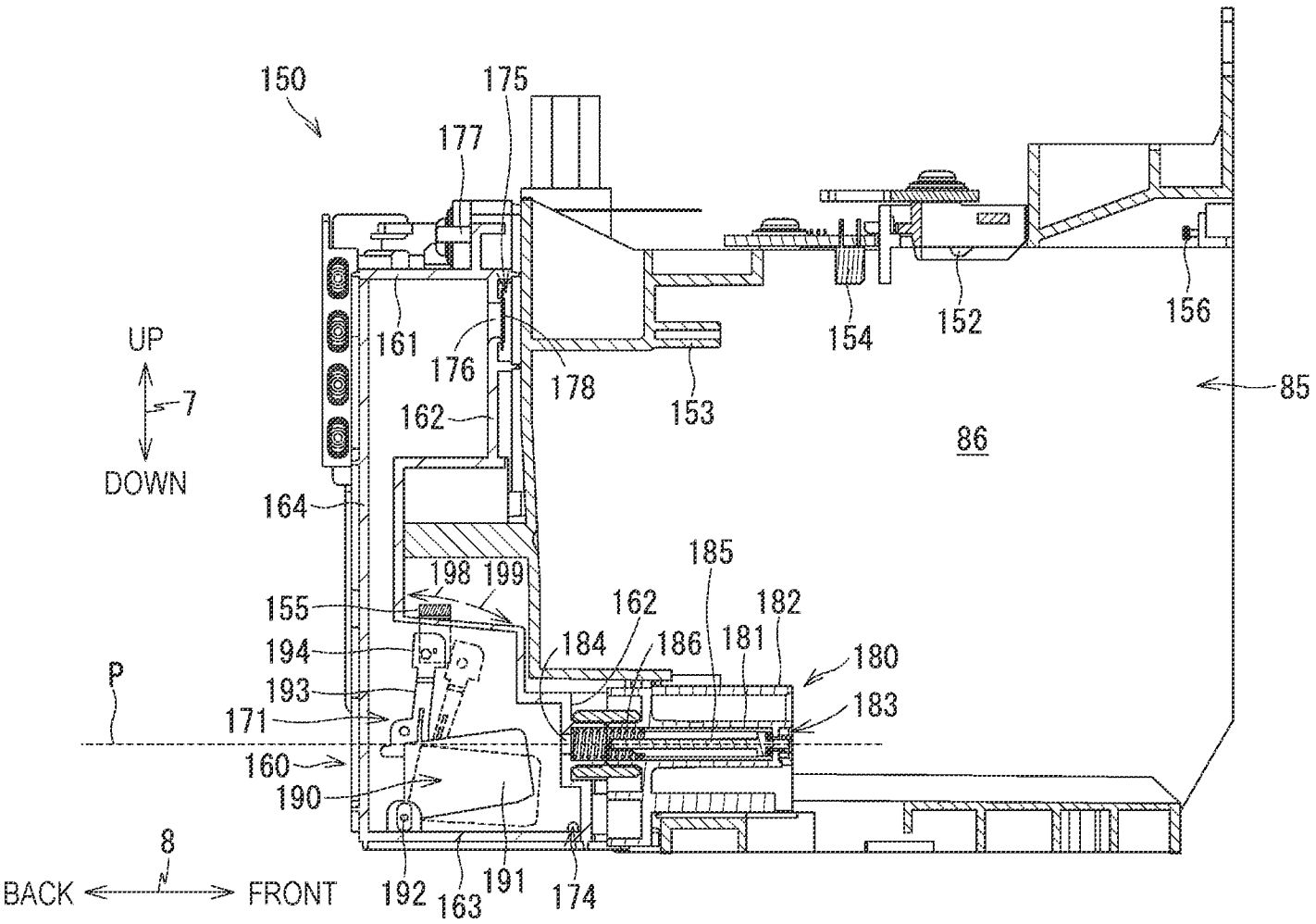
FIG. 4 is a vertical cross-sectional view of an installation case.

As illustrated in FIG. 4, the installation case 150 includes a contact point 152, a rod 153, an installation sensor 154, a liquid level sensor 155, and a lock pin 156. The installation case 150 can contain four cartridges 200 corresponding to black, cyan, magenta, and yellow. In other words, the installation case 150 includes the contact point 152, the rod 153, and the installation sensor 154. Four liquid level sensors 155 are provided in correspondence with four cartridges 200. The number of cartridges 200 containable in the installation case 150 is not limited to "4", or may be "1" or "5" or more.

The installation case 150 is a box shape having an inner space where the installed cartridge 200 is contained. The inner space of the installation case 150 is partitioned by a ceiling wall to form the upper end, a bottom wall to form the lower end, a depth wall to form the rear end in the forward and backward direction 8, and a pair of side walls to form both ends in the right and left direction 9. On the other hand, the opening 85 is located at the position opposite to the depth wall of the installation case 150. In other words, the opening 85 opens the inner space of the installation case 150 to the outside of the printer 10 when the cover 87 is located at the open position.

The cartridge 200 is inserted to the installation case 150 through the opening 85 of the housing 14, and released from the installation case 150. More specifically, the cartridge 200 passes through the opening 85 in a backward direction along the forward and backward direction 8 and is installed in the installation case 150. The cartridge 200 released from the installation case 150 passes through the opening 85 in the forward direction along the forward and backward direction 8.

(Contact Point)

The contact point 152 is located in the ceiling wall of the installation case 150. The contact point 152 protrudes to the lower side from the ceiling wall toward the inner space of the installation case 150. The contact point 152 is located at a position abutting on an electrode 248 (described below) of the cartridge 200 in a state where the cartridge 200 is installed in the installation case 150. The contact point 152 has conductivity, and can be elastically deformed along the upward and downward direction 7. The contact point 152 is electrically connected to the controller 130. The contact point 152 is an example of an interface.

(Rod)

The rod 153 protrudes from the depth wall of the installation case 150 to the front side. The rod 153 is located on the upper side from a joint 180 (described above) in the depth wall of the installation case 150. The rod 153 enters an atmosphere valve chamber 214 through an atmosphere communicating port 221 (described below) of the cartridge 200 in process of installing the cartridge 200 in the installation case 150. When the rod 153 enters the atmosphere valve chamber 214, the atmosphere valve chamber 214 (described below) communicates to the atmosphere.

(Installation Sensor)

The installation sensor 154 is located in the ceiling wall of the installation case 150. The installation sensor 154 is a sensor to detect whether the cartridge 200 is installed in the installation case 150. The installation sensor 154 includes a light emitting portion and a light receiving portion which are separated in the right and left direction 9. In a state where the cartridge 200 is installed in the installation case 150, a light shielding rib 245 (described below) of the cartridge 200 is located between the light emitting portion and the light receiving portion of the installation sensor 154. In other words, the light emitting portion and the light receiving portion of the installation sensor 154 interpose the light shielding rib 245 of the cartridge 200 installed in the installation case 150, and located in a state of facing each other.

The installation sensor 154 outputs different signals (referred to as "installation signal" in the drawing) according to whether the light emitted from the light emitting portion along the right and left direction 9 is received by the light receiving portion. For example, the installation sensor 154 outputs the low level signal to the controller 130 when the intensity of the light received by the light receiving portion is less than threshold intensity. On the other hand, the installation sensor 154 outputs the high level signal having a signal intensity higher than that of the low level signal to the controller 130 when the intensity of the light received by the light receiving portion is equal to or more than the threshold intensity.

(Liquid Level Sensor)

The liquid level sensor 155 is a sensor to detect whether a detection portion 194 of an actuator 190 (described below) is located at a detection position. The liquid level sensor 155 includes a light emitting portion and a light receiving portion which are separated in the right and left direction 9. In other words, the light emitting portion and the light receiving portion of the liquid level sensor 155 interpose the detection portion 194 located at the detection position, and face to each other. The liquid level sensor 155 outputs different signals (referred to as "liquid level signal" in the drawing) according to whether the light output from the light emitting portion is received by the light receiving portion. For example, the liquid level sensor 155 outputs the low level signal to the controller 130 when the intensity of the light received by the light receiving portion is less than the threshold intensity. On the other hand, the liquid level sensor 155 outputs the high level signal having a signal intensity higher than that of the low level signal to the controller 130 when the intensity of the light received by the light receiving portion is equal to or more than the threshold intensity. The low level signal is an example of a first signal. The high level signal is an example of a second signal.

(Lock Pin)

The lock pin 156 is a member of a rod shape extending along the right and left direction 9 in the upper end of the inner space of the installation case 150 and near the opening 85. Both ends of the right and left direction 9 of the lock pin 156 are fixed to the pair of side walls of the installation case 150. The lock pin 156 extends in the right and left direction 9 along the four spaces where four cartridges 200 are contained. The lock pin 156 is used to hold the cartridge 200 installed in the installation case 150 at an installation position illustrated in FIG. 6. The cartridge 200 is engaged to the lock pin 156 in a state of being installed in the installation case 150.

(Tank)

The printer 10 includes four tanks 160 corresponding to four cartridges 200. The configurations of four tanks 160 are almost common, and thus one tank 160 will be described below. The tank 160 is located in the rear side from the depth wall of the installation case 150. The tank 160 is configured by, as illustrated in FIG. 4, an upper wall 161, a front wall 162, a lower wall 163, a rear wall 164, and a pair of side walls (not illustrated). The front wall 162 is configured by a plurality of walls which are shifted in the forward and backward direction 8. In the inner portion of the tank 160, a liquid chamber 171 is formed. The liquid chamber 171 is an example of a second liquid chamber.

Among the walls of the tank 160, at least a surface facing the liquid level sensor 155 has transmittance. With this configuration, the light output by the liquid level sensor 155 can transmit the wall facing the liquid level sensor 155. At least a part of the rear wall 164 may be formed by a film melt and attached to the upper wall 161, the lower wall 163, and the end surfaces of the side wall. The side wall of the tank 160 may be common to the installation case 150, or may be independent of the installation case 150. Further, the tanks 160 adjacent in the right and left direction 9 are divided by a partition wall (not illustrated).

The liquid chamber 171 is connected to an ink path (not illustrated) through an outlet 174. The lower end of the outlet 174 is defined by the lower wall 163 which defines the lower end of the liquid chamber 171. The outlet 174 is located on the lower side in the upward and downward direction 7 from the joint 180 (more specifically, the lower end of a through hole 184). The ink path (not illustrated) connected to the outlet 174 is connected to a tube 32 (see FIG. 2). With this configuration, the liquid chamber 171 is connected to the head 21 from the outlet 174 through the ink path and the tube 32. In other words, the ink stored in the liquid chamber 171 is supplied from the outlet 174 to the head 21 through the ink path and the tube 32. The ink path and the tube 32 connected to the outlet 174 are a flow path of which one end (the outlet 174) is connected to the liquid chamber 171, and the other end 33 (see FIG. 2) is connected to the head 21.

The liquid chamber 171 communicates to the atmosphere through an atmosphere communicating chamber 175. More specifically, the atmosphere communicating chamber 175 is connected to the liquid chamber 171 by a through hole 176 which passes through the front wall 162. The through hole 176 is covered by a semipermeable film 178. The semipermeable film 178 has a property that the air passes through the film but the ink does not pass through. The semipermeable film 178 may have a property of imparting a large resistance to the ink passing through the semipermeable film 178 rather than the air passing through the semipermeable film 178. The atmosphere communicating chamber 175 communicates with the outside of the printer 10 through an atmosphere communicating port 177 and a tube (not illustrated) which is connected to the atmosphere communicating port 177. The atmosphere communicating chamber 175 communicates to the atmosphere through the atmosphere communicating port 177 and the tube (not illustrated).

(Joint)

As illustrated in FIG. 4, the joint 180 includes a needle 181 and a guide 182. The needle 181 is a pipe in which a flow path is formed. The needle 181 protrudes toward the front side from the front wall 162 which defines the liquid chamber 171. In the front end of the needle 181, an opening 183 is formed. The inner space of the needle 181 passes through the through hole 184 which passes through the front wall 162, and is connected to the liquid chamber 171. The guide 182 is a cylindrical member which is disposed around the needle 181. The guide 182 protrudes to the front side from the front wall 162, and the front end is open.

In the inner space of the needle 181, a valve 185 and a coil spring 186 are located. The valve 185 is movable along the forward and backward direction 8 between the close position and the open position in the inner space of the needle 181. The valve 185 closes the opening 183 when being located at the close position. The valve 185 opens the opening 183 when being located at the open position. The coil spring 186 moves the valve 185 from the open position to the close position, that is, urges the valve forward in the forward and backward direction 8.

(Actuator)

As illustrated in FIG. 4, the actuator 190 is located in the liquid chamber 171. The actuator 190 is rotatably supported in directions of arrows 198 and 199 by a support member (not illustrated) disposed in the liquid chamber 171. The actuator 190 can rotate between the position indicated by the solid line and the broken line of FIG. 4. Further, the actuator 190 is restricted in its rotation in the direction of arrow 198 from the position indicated in the solid line by a stopper (not illustrated; for example, the inner wall of the liquid chamber 171). The actuator 190 includes a float 191, a shaft 192, an arm 193, and the detection portion 194.

The float 191 is formed of a material having a specific gravity smaller than that of the ink stored in the liquid chamber 171. The shaft 192 protrudes along the right and left direction 9 from the right surface to the left surface of the float 191. The shaft 192 is inserted to a hole (not illustrated) formed in the support member. With this configuration, the actuator 190 is supported by the support member to be rotatable about the shaft 192. The arm 193 extends from the float 191 to the substantially upward side. The detection portion 194 is located at the tip end of the protruding arm 193. The detection portion 194 is a plate member which extends in the upward and downward direction 7 and the forward and backward direction 8. The detection portion 194 is formed of a material or with color to shield the light output from the light emitting portion of the liquid level sensor 155.

When the liquid surface of the ink in the liquid chamber 171 is equal to or higher than a predetermined position P, the actuator 190 rotated in the direction of arrow 198 by a buoyant force is held at the detection position indicated by the solid line of FIG. 4 by a stopper. On the other hand, when the liquid surface of the ink is less than the predetermined position P, the actuator 190 rotates in the direction of arrow 199 in following the falling of the liquid level. With this configuration, the detection portion 194 moves a position away from the detection position. In other words, the detection portion 194 moves to a position corresponding to the amount of ink stored in the liquid chamber 171.

The predetermined position P is the same as the axial center of the needle 181 in the upward and downward direction 7, and the same as the center of an ink supply port 234 described below. However, the predetermined position P is not limited to the above-described position as long as the position is located upper than the outlet 174 in the upward and downward direction 7. As another example, the predetermined position P may be a height of the upper end or the lower end of the inner space of the needle 181, or may be a height of the upper end or the lower end of the ink supply port 234.

When the liquid level of the ink stored in the liquid chamber 171 is equal to or higher than the predetermined position P, the light output from the light emitting portion of the liquid level sensor 155 is blocked by the detection portion 194. With this configuration, since the light output from the light emitting portion not reach the light receiving portion, the liquid level sensor 155 outputs the low level signal to the controller 130. On the other hand, when the liquid level of the ink stored in the liquid chamber 171 is less than the predetermined position P, the light output from the light emitting portion of the liquid level sensor 155 is not blocked by the detection portion 194. With this configuration, since the light output from the light emitting portion reaches the light receiving portion, the liquid level sensor 155 outputs the high level signal to the controller 130. In other words, the controller 130 can detect whether the liquid level of the ink in the liquid chamber 171 is equal to or higher than the predetermined position P by the signal output from the liquid level sensor 155.

(Cartridge)

Figure 5A:
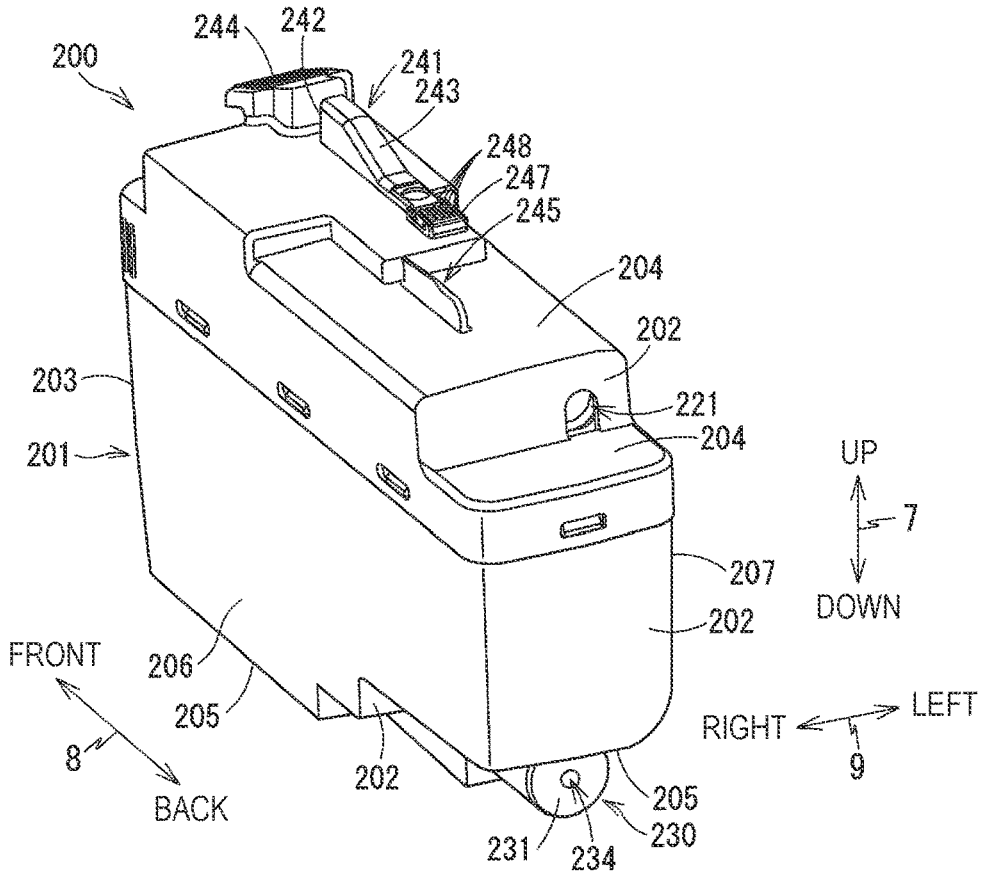

The cartridge 200 is a mechanism which includes a liquid chamber 210 (see FIG. 2) which can store the liquid ink therein. The liquid chamber 210 is defined by resin walls for example. The cartridge 200 has a flat shape such that dimensions along the upward and downward direction 7 and the forward and backward direction 8 are larger than those along the right and left direction 9 as illustrated in FIG. 5A. The outer shape of the cartridges 200 storing the different colors of ink may be equal or different. At least a part of the walls of the cartridge 200 has transmittance. With this configuration, a user can view the liquid level of the ink stored in the liquid chamber 210 of the cartridge 200 from the outside of the cartridge 200.

The cartridge 200 includes a housing 201 and a feed pipe 230. The housing 201 is configured by a rear wall 202, a front wall 203, an upper wall 204, a lower wall 205, and a pair of side walls 206 and 207. The rear wall 202 is configured by a plurality of walls each shifted in the forward and backward direction 8. The upper wall 204 is configured by a plurality of walls each shifted in the upward and downward direction 7. Further, the lower wall 205 is configured by a plurality of walls each shifted in the upward and downward direction 7.

Figure 5B:
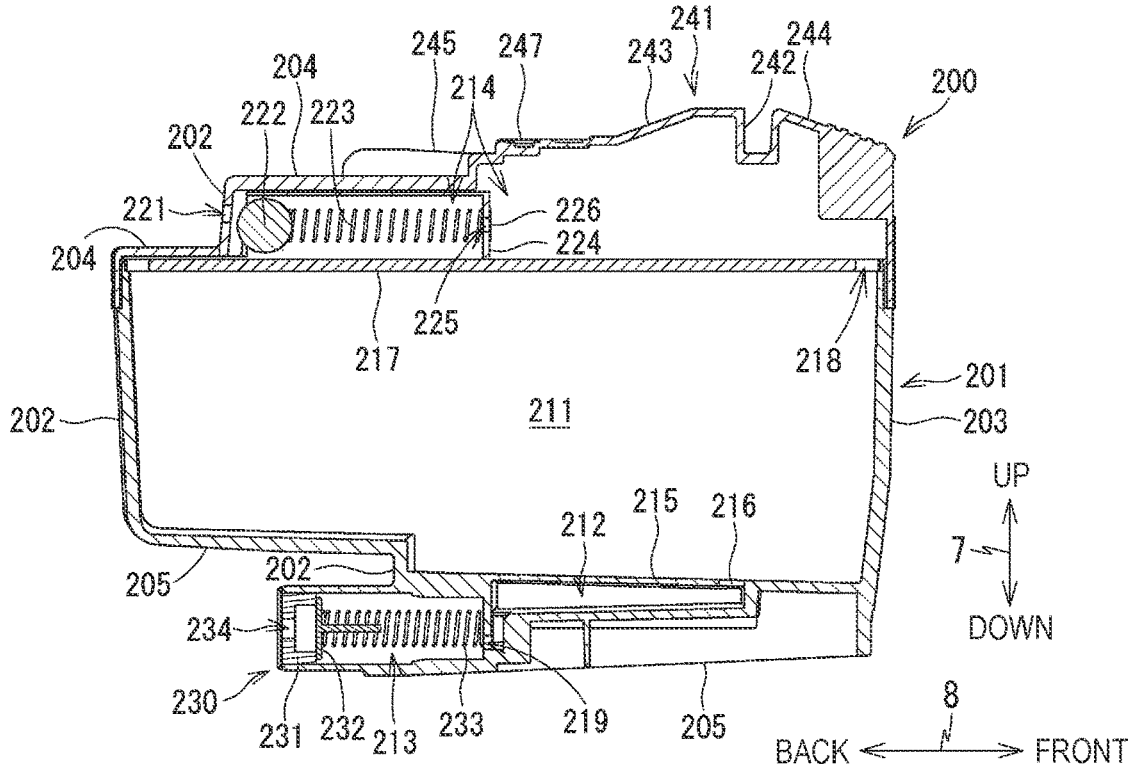

In the inner space of the cartridge 200, as illustrated in FIG. 5B, the liquid chamber 210, an ink valve chamber 213, and the atmosphere valve chamber 214 are formed. The liquid chamber 210 includes an upper liquid chamber 211 and a lower liquid chamber 212. The upper liquid chamber 211, the lower liquid chamber 212, and the atmosphere valve chamber 214 are the inner space of the housing 201. On the other hand, the ink valve chamber 213 is the inner space of the feed pipe 230. The liquid chamber 210 stores ink. The atmosphere valve chamber 214 connects the liquid chamber 210 and the outside of the cartridge 200. The liquid chamber 210 is an example of a first liquid chamber.

The upper liquid chamber 211 and the lower liquid chamber 212 of the liquid chamber 210 are separated in the upward and downward direction 7 by a partition 215 which divides the inner space of the housing 201. The upper liquid chamber 211 and the lower liquid chamber 212 are connected by a through hole 216 which is formed in the partition 215. The upper liquid chamber 211 and the atmosphere valve chamber 214 are separated in the upward and downward direction 7 by a partition 217 which divides the inner space of the housing 201. The upper liquid chamber 211 and the atmosphere valve chamber 214 are connected by a through hole 218 which is formed in the partition 217. Further, the ink valve chamber 213 is connected to the lower end of the lower liquid chamber 212 through a through hole 219.

The atmosphere valve chamber 214 is connected to the outside of the cartridge 200 through the atmosphere communicating portion 221 which is formed in the rear wall 202 in the upper portion of the cartridge 200. In other words, the atmosphere valve chamber 214 serves as a flow path of which one end (the through hole 218) is connected to the liquid chamber 210 (more specifically, the upper liquid chamber 211) and the other end (the atmosphere communicating port 221) is connected to the outside of the cartridge 200. The atmosphere valve chamber 214 communicates to the atmosphere through the atmosphere communicating port 221. In the atmosphere valve chamber 214, a valve 222 and a coil spring 223 are located. The valve 222 is movable along the forward and backward direction 8 between the close position and the open position. When being located at the close position, the valve 222 closes the atmosphere communicating port 221. When being located at the open position, the valve 222 opens the atmosphere communicating port 221. The coil spring 223 urges the valve 222 in a direction from the open position to the close position, that is, the backward direction of the forward and backward direction 8.

The atmosphere valve chamber 214 is divided into two rooms in the forward and backward direction 8 by a partition 224. In the room located on the rear side of the forward and backward direction 8, the valve 222 and the coil spring 223 are provided, and the room is connected to the outside through the atmosphere communicating port 221. The room located on the forward side of the forward and backward direction 8 is connected to the upper liquid chamber 211 through the through hole 218. In the partition 224, a through hole 225 is formed. The through hole 225 is connected to the two rooms divided in the forward and backward direction 8. The through hole 225 is coated by a semipermeable film 226. The semipermeable film 226 has a property that the air can pass therethrough but not the ink. The semipermeable film 226 may have a property of giving a large resistance to the ink passing through the semipermeable film 226 rather than the air passing through the semipermeable film 226.

In process of installing the cartridge 200 in the installation case 150, the rod 153 enters the atmosphere valve chamber 214 through the atmosphere communicating port 221. The rod 153 entered the atmosphere valve chamber 214 moves the valve 222 at the closed position to the forward direction against the urging force of the coil spring 223. When the valve 222 moves in the open position, the upper liquid chamber 211 communicates to the atmosphere. The configuration of opening the atmosphere communicating port 221 is not limited to the above example. As another example, the film for sealing the atmosphere communicating port 221 may be configured to be broken by the rod 153.

The feed pipe 230 protrudes from the rear wall 202 to the rear side in the lower portion of the housing 201. The protruding end (that is, the rear end) of the feed pipe 230 is opened. In other words, the ink valve chamber 213 connects the liquid chamber 210 connected through the through hole 219 and the outside of the cartridge 200. The inner space of the ink valve chamber 213 and the needle 181 is an example of the flow path of which one end (the through hole 219) is connected to the liquid chamber 210 (more specifically, the lower liquid chamber 212), and the other end (the through hole 184, see FIG. 4) is connected to the liquid chamber 171 of the tank 160. In the ink valve chamber 213, a packing 231, a valve 232, and a coil spring 233 are located.

In the center of the packing 231, the ink supply port 234 passing through the forward and backward direction 8 is formed. The inner diameter of the ink supply port 234 is slightly smaller than the outer diameter of the needle 181. The valve 232 is movable along the forward and backward direction 8 between the close position and the open position. When being located at the close position, the valve 232 abuts on the packing 231 to close the ink supply port 234. When being located at the open position, the valve 232 is separated from the packing 231 to open the ink supply port 234. The coil spring 233 is urged in a direction of moving the valve 232 from the open position to the close position, that is, the backward direction of the forward and backward direction 8. The urging force of the coil spring 233 is larger than that of the coil spring 186.

In process of installing the cartridge 200 in the installation case 150, the feed pipe 230 enters the guide 182, and then the needle 181 enters the ink valve chamber 213 through the ink supply port 234. At this time, the needle 181 comes into liquid-tight contact with the inner peripheral surface which defines the ink supply portion 234 while elastically deforming the packing 231. When the cartridge 200 is inserted into the installation case 150 further, the needle 181 moves the valve 232 to the forward direction against the urging force of the coil spring 233. The valve 232 moves the valve 185 protruding the opening 183 of the needle 181 in the backward direction against the urging force of the coil spring 186.

Figure 6:
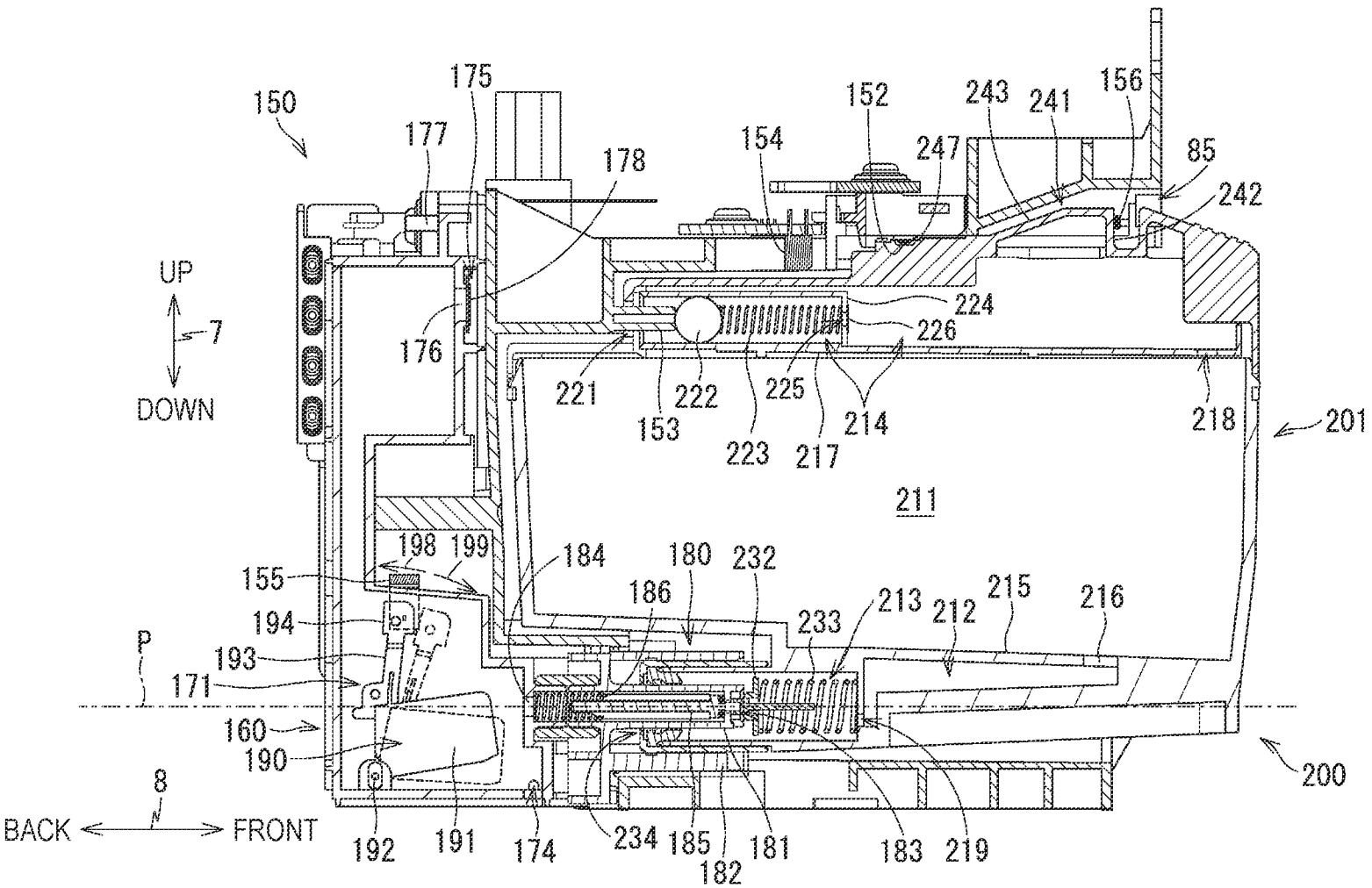
FIG. 6 is a vertical cross-sectional view of a state where the cartridge is installed in the installation case.

With this configuration, as illustrated in FIG. 6, the ink supply port 234 and the opening 183 are opened, and the ink valve chamber 213 of the feed pipe 230 and the inner space of the needle 181 are connected. In other words, in a state where the cartridge 200 is installed in the installation case 150, the inner space of the ink valve chamber 213 and the needle 181 forms the flow path which connects the liquid chamber 210 of the cartridge 200 and the liquid chamber 171 of the tank 160.

In a state where the cartridge 200 is installed in the installation case 150, part of the liquid chamber 210 and part of the liquid chamber 171 are overlapped to each other when viewed in the horizontal direction. As a result, the ink stored in the liquid chamber 210 moves to the liquid chamber 171 of the tank 160 by a water head difference through the feed pipe 230 and the joint 180 which are connected.

As illustrated in FIG. 5, a projection 241 is formed in the upper wall 204. The projection 241 protrudes from the outer surface of the upper wall 204 to the upper side, and extends along the forward and backward direction 8. The projection 241 includes a lock surface 242 and a slope surface 243. The lock surface 242 and the slope surface 243 are located on the upper side from the upper wall 204. The lock surface 242 extends in the forward direction of the forward and backward direction 8 and in the upward and downward direction 7 and the right and left direction 9 (that is, approximately orthogonal to the upper wall 204). The slope surface 243 is inclined with respect to the upper wall 204 to face the upper side in the upward and downward direction 7 and the rear side of the forward and backward direction 8.

The lock surface 242 is a surface abutting on the lock pin 156 in a state where the cartridge 200 is installed in the installation case 150. The slope surface 243 is a surface guiding the lock pin 156 up to the position of abutting on the lock surface 242 in process of installing the cartridge 200 in the installation case 150. In a state where the lock surface 242 and the lock pin 156 abut on, the cartridge 200 is held in the installation position illustrated in FIG. 6 against the urging force of the coil springs 186, 223, and 233.

A flat member is formed to extend from the upper wall 204 to the upper side in front of the lock surface 242. The upper surface of the flat member is an operation portion 244 which is operated by the user when the cartridge 200 is pulled out of the installation case 150. The operation portion 244 can be operated by the user in a state where the cartridge 200 is installed in the installation case 150 and when the cover 87 is located at the open position. When the operation portion 244 is pushed to the lower side, the cartridge 200 rotates, and the lock surface 242 moves to the lower side from the lock pin 156. As a result, the user can pull the cartridge 200 out of the installation case 150.

As illustrated in FIGS. 5A and 5B, the light shielding rib 245 is formed in the outer surface of the upper wall 204 and on the rear side from the projection 241. The light shielding rib 245 protrudes from the outer surface of the upper wall 204 to the upper side and extends along the forward and backward direction 8. The light shielding rib 245 is formed of a material or a color shielding the light output from the light emitting portion of the installation sensor 154. The light shielding rib 245 is located on an optical path from the light emitting portion up to the light receiving portion of the installation sensor 154 in a state where the cartridge 200 is installed in the installation case 150. In other words, the installation sensor 154 outputs the low level signal to the controller 130 when the cartridge 200 is installed in the installation case 150. On the other hand, the installation sensor 154 outputs the high level signal to the controller 130 when the cartridge 200 is not installed in the installation case 150. In other words, the controller 130 can detect whether the cartridge 200 is installed in the installation case 150 by the signal output from the installation sensor 154.

As illustrated in FIGS. 5A and 5B, an IC substrate 247 is located in the outer surface of the upper wall 204 and between the light shielding rib 245 and the projection 241 in the forward and backward direction 8. The electrode 248 is formed in the IC substrate 247. The IC substrate 247 includes a memory (not illustrated). The electrode 248 is electrically connected to the memory of the IC substrate 247. The electrode 248 is exposed to be electrically connected to the contact point 152 in the upper surface of the IC substrate 247. In other words, the electrode 248 is electrically connected to the contact point 152 in a state where the cartridge 200 is installed in the installation case 150. The controller 130 can read information from the memory of the IC substrate 247 through the contact point 152 and the electrode 248, and write information in the memory of the IC substrate 247 through the contact point 152 and the electrode 248. The memory of the IC substrate 247 is an example of a cartridge memory.

The memory of the IC substrate 247 stores identification information to identify an ink amount Vc and an individual cartridge 200. Hereinbelow, the information stored in the memory of the IC substrate 247 will be collectively referred to as "CTG information". In the memory of the IC substrate 247 of a new cartridge 200, an initial ink amount Vc0 is stored as the ink amount Vc. The initial ink amount Vc0 is an ink amount stored in the new cartridge 200. The expression "new" means a so-called unused product, and indicates a state that the ink in the cartridge 200 has not been discharged to the outside even once from the manufactured commercial cartridge 200 (so-called a brand new cartridge). The initial state of the cartridge indicates a state that the ink is not discharged to the outside from the liquid chamber 210.

(Controller)

As illustrated in FIG. 7, the controller 130 includes a CPU 131, a ROM 132, a RAM 133, an EEPROM 134, and an ASIC 135. In the ROM 132, a program used for the CPU 131 to control various types of operations is stored. The RAM 133 is used as a memory area to temporarily store data and signals used when the CPU 131 executes the program, or a work area for data processing. In the EEPROM 134, setting information to be held even after power is turned off is stored. The ROM 132, the RAM 133, and the EEPROM 134 are examples of a memory.

The ASIC 135 is used to operate the feed roller 23, the conveyance roller 25, the discharge roller 27, the head 21, and the pump 73. The controller 130 operates a motor (not illustrated) through the ASIC 135 to rotate the feed roller 23, the conveyance roller 25, and the discharge roller 27 or to drive the pump 73. The controller 130 outputs a drive signal to a drive element of the head 21 through the ASIC 135 to eject the ink to the head 21 through the nozzle 29. The ASIC 135 can output a plural types of drive signals according to the size of an ink droplet to be ejected through the nozzle 29.

A display 17 and an operation panel 22 are connected to the ASIC 135. The display 17 is a liquid crystal display or an organic EL display, and includes a display surface which displays various types of information. The display 17 is an example of a notification device (which may also be referred to as an alarm). However, a specific example of the notification device is not limited to the display 17, and may be a speaker, an LED lamp, or a combination thereof. The operation panel 22 outputs an operation signal according to an operation of the user to the controller 130. The operation panel 22 may include a push button, or may include a touch sensor overlapped on the display.

Further, the contact point 152, the cover sensor 88, the installation sensor 154, and the liquid level sensor 155 are electrically connected to the ASIC 135. The controller 130 has an access to the memory of the IC substrate 247 of the cartridge 200 installed in the installation case 150 through the contact point 152. The controller 130 detects the position of the cover 87 through the cover sensor 88. The controller 130 detects whether the cartridge 200 is installed in the installation case 150 through the installation sensor 154. Further, the controller 130 detects whether the liquid level of the ink in the liquid chamber 171 is equal to or higher than the predetermined position P through the liquid level sensor 155.

The EEPROM 134 stores various types of information in association with four cartridges 200 installed in the installation case 150, that is, in association with each tank 160 connected to the cartridge 200. The various types of information include the ink amounts Vc and Vs as an example of liquid amount, a function F, values T1, T2, and T3 serving as thresholds, waiting times Tw1, Tw2, and Tw3, and identification information. Time T1 is an example of a first time. The waiting time Tw1 is an example of a second time. Time T2 is an example of a third time.

The ink amount Vc and the identification information stored in the memory of the IC substrate 247 are information which is read by the controller 130 through the contact point 152 in a state where the cartridge 200 is installed in the installation case 150. The controller 130 stores the ink amount Vc and the identification information which are read from the memory of the IC substrate 247 through the contact point 152 in the EEPROM 134. The function F may be stored in the ROM 132 instead of the EEPROM 134.

The ink amount Vc indicates an amount of ink stored in the liquid chamber 210 of the cartridge 200. The ink amount Vs indicates an amount of ink stored in the liquid chamber 171 of the tank 160. The ink amounts Vc and Vs are calculated by the function F for example. The function F is information indicating a correspondence relation among a total amount Vt of the ink, the ink amount Vc, and the ink amount Vs. The ink of the liquid chamber 210 of the cartridge 200 and the ink of the liquid chamber 171 of the tank 160 are equal in a state where the positions of the ink liquid levels in the upward and downward direction 7 are matched. In other words, in the equal state, the ink movement between the liquid chamber 210 and the liquid chamber 171 is stopped. For example, the relation between the total amount Vt of the ink and the ink amount Vs can be approximated by the function F. Therefore, when the total amount Vt of the ink is calculated, the ink amount Vs and the ink amount Vc can be obtained. The ink amount Vs and the ink amount Vc are not limited to the format of the function F, and may be obtained according to a table associated to each total amount Vt.

(Operation of Printer)

Figure 8:
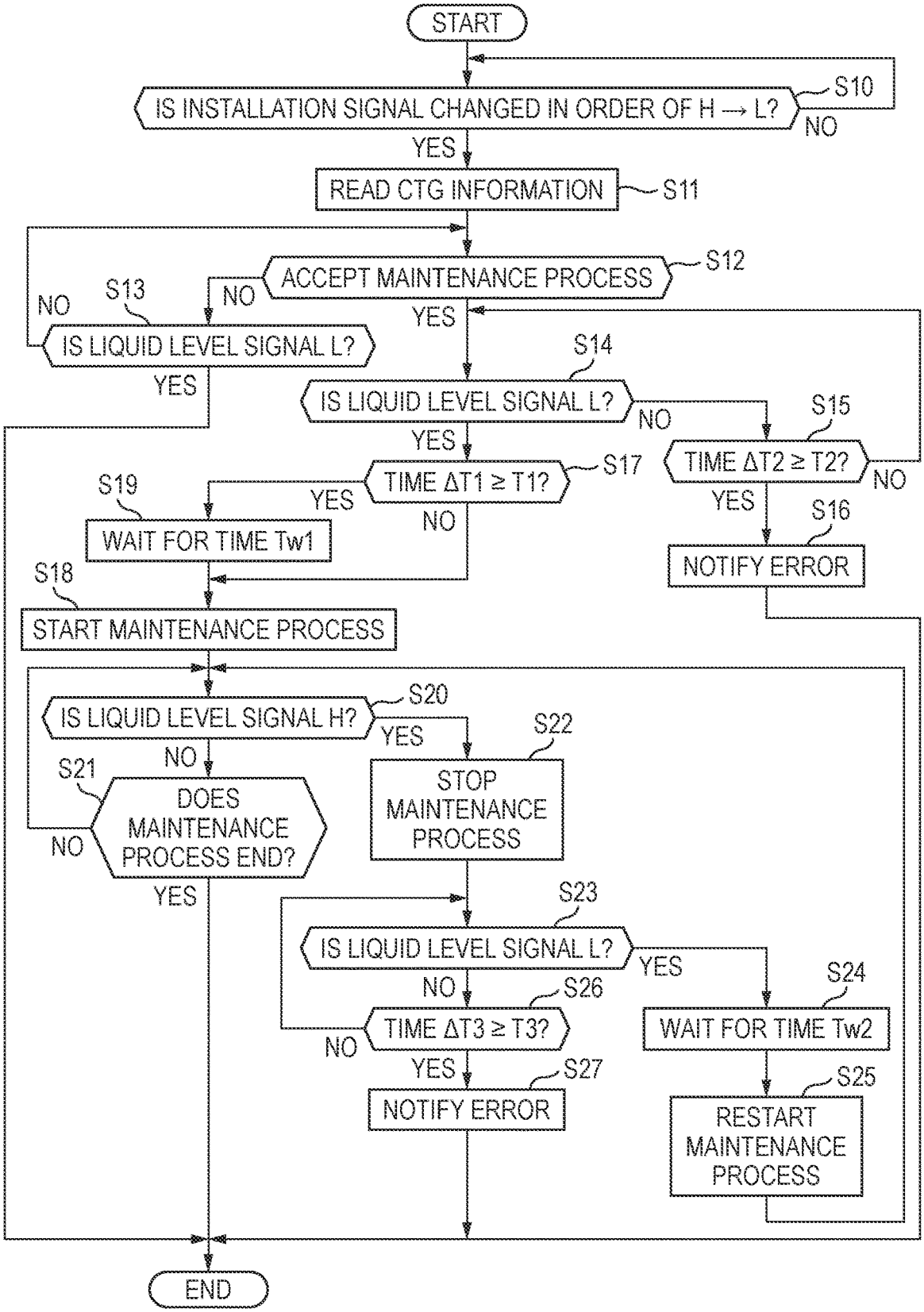
FIG. 8 is a flowchart of a maintenance process of a first illustrative embodiment.

The operation of the printer 10 according to this illustrative embodiment will be described with reference to FIG. 8. A maintenance process illustrated in FIG. 8 is performed by the CPU 131 of the controller 130. The following processes may be performed by the CPU 131 which reads a program stored in the ROM 132, or may be realized by a hardware circuit installed in the controller 130. The order of performing the following processes may be appropriately changed within a scope not departing from the spirit of the disclosure.

The controller 130 performs the maintenance process by the user who inputs the execution of the maintenance process in the operation panel 22. The controller 130 performs the maintenance process at every predetermined time. When the user inputs a recording instruction to the printer 10, the controller 130 discharges the ink from the head 21 to record an image. When the head 21 discharges the ink, the gas dissolved in the ink may become bubbles and enter the nozzle 29 of the head 21. The meniscus of ink may be damaged in the nozzle 29 by an external force. As a result, a desired ink is not discharged from the nozzle 29 of the head 21. When an error occurs in any nozzle 29, a desired image is not recorded in the sheet, and thus the quality of the recorded image is degraded.

The maintenance process is performed on the abnormality of any nozzle 29, and the state of the nozzle 29 is revived to be normal. With the execution of the maintenance process, the controller 130 locates the head 21 at the home position, and covers the nozzle surface of the head 21 with a cap. The bubbles are discharged from the nozzle 29 by driving the pump 73 to absorb the ink from the nozzle 29 of the head 21.

The ink stored in the cartridge 200 installed in the installation case 150 is consumed as the head 21 discharges the ink. When all the ink stored in the liquid chamber 210 of the cartridge 200 installed in the installation case 150 is consumed, the user exchanges the cartridge 200 installed in the installation case 150 with another cartridge 200. The other cartridge 200 may be a new cartridge 200, or may be the cartridge 200 in which some portion of the ink is consumed already.

Figure 9A:
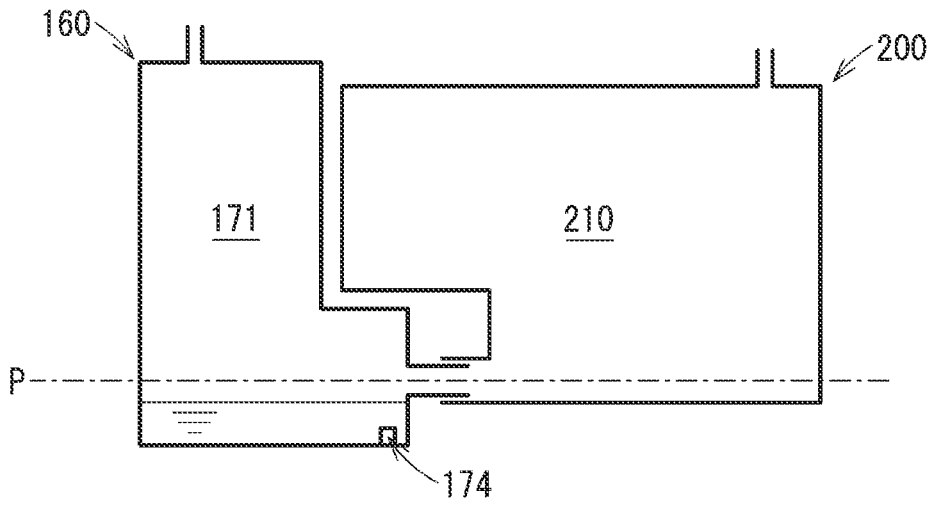
FIG. 9A illustrates a state where all the ink stored in a liquid chamber of the cartridge is consumed.

As illustrated in FIG. 9A, when all the ink stored in the liquid chamber 210 of the cartridge 200 installed in the installation case 150 is consumed, and part of the ink in the liquid chamber 171 of the tank 160 is consumed, the liquid level of the ink in the liquid chamber 171 becomes less than the predetermined position P. When the liquid level of the ink in the liquid chamber 171 becomes less than the predetermined position P, the liquid level sensor 155 outputs the high level signal. The controller 130 receiving the high level signal from the liquid level sensor 155 displays that the cartridge 200 installed in the installation case 150 is empty in the display 17. The user who confirms the content displayed in the display 17 exchanges the cartridge 200 installed in the installation case 150.

Figure 9B:
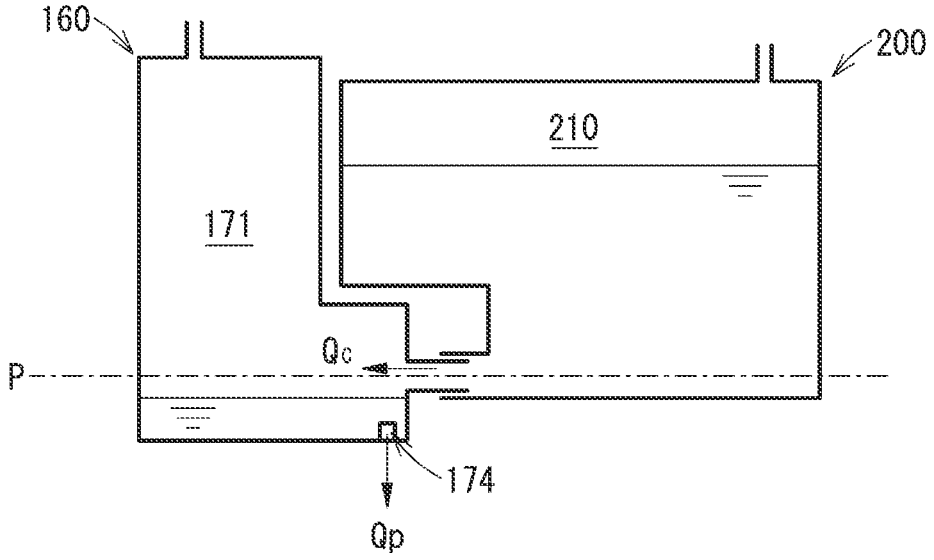
FIG. 9B illustrates a state where the cartridge is installed in the installation case and the ink moves from the liquid chamber to a liquid chamber.

As illustrated in FIG. 9B, when the cartridge 200 is exchanged, there occurs a difference between the liquid level of the ink in the liquid chamber 210 of the exchanged cartridge 200 and the liquid level of the ink in the liquid chamber 171 of the tank 160. The difference is a so-called water head difference. The ink moves from the liquid chamber 210 to the liquid chamber 171 at a flow rate Qc by the water head difference. In other words, the ink flows into the liquid chamber 171 at the flow rate Qc. When the maintenance process is performed before the liquid level of the ink of the liquid chamber 210 and the liquid level of the ink of the liquid chamber 171 become even, the ink flows out from the liquid chamber 171 at a flow rate Qp. When the flow rate Qp is larger than the flow rate Qc (Flow amount Qp>Flow amount Qc) and the maintenance process is performed, the liquid level of the ink in the liquid chamber 171 may be lowered to reach the outlet 174. When the liquid level of the ink of the liquid chamber 171 reaches the outlet 174, the gas enters toward the tube 32 and the head 21. In order to prevent that the gas enters toward the tube 32 and the head 21, the controller 130 performs the following control when the user inputs the execution of the maintenance process after the cartridge 200 is exchanged.

The controller 130 performs the process illustrated in FIG. 8 on the basis of the reception of the high level signal from the installation sensor 154. The controller 130 determines whether the low level signal is received from the installation sensor 154 thereafter (S10). The controller 130 receives the high level signal from the installation sensor 154, and stores the time in the EEPROM 134 when the low level signal is received from the installation sensor 154 (S10: Yes). The time is actually a time at a point when the cartridge 200 is installed in the installation case 150. When the controller 130 receives the low level signal from the installation sensor 154, the cartridge 200 is installed in the installation case 150. When the controller 130 receives the high level signal from the installation sensor 154, the cartridge 200 is not installed in the installation case 150.

Subsequently, the controller 130 reads the CTG information such as the identification information and the ink amount Vc from the memory of the IC substrate 247 of the cartridge 200 installed in the installation case 150 (S11). The controller 130 stores the read CTG information in the EEPROM 134.

The controller 130 determines whether the execution of the maintenance process (e.g., a request for performing the maintenance process) is input to the operation panel 22 (S12). When determining that the execution of the maintenance process is not input (S12: No), the controller 130 determines whether the signal received from the liquid level sensor 155 is the low level signal (S13). When determining that the low level signal is not received from the liquid level sensor 155 (S13: No), the controller 130 performs S12. When determining that the low level signal is received from the liquid level sensor 155 (S13: Yes), the controller 130 ends the control including the maintenance process. When the controller 130 receives the low level signal from the liquid level sensor 155, the liquid level of the ink in the liquid chamber 171 is equal to or higher than the predetermined position P. When the controller 130 receives the high level signal from the liquid level sensor 155, the liquid level of the ink in the liquid chamber 171 is less than the predetermined position P.

When determining that the execution of the maintenance process is input (S12: Yes), the controller 130 determines whether the signal received from the liquid level sensor 155 is the low level signal (S14). As illustrated in FIG. 9B, for example, when the new cartridge 200 is installed in the installation case 150, the ink starts to flow from the liquid chamber 210 to the liquid chamber 171. When a time elapses after the ink starts to flow, the liquid level of the ink in the liquid chamber 171 reaches the predetermined position P, and the liquid level sensor 155 outputs the low level signal.

When determining that the low level signal is not received from the liquid level sensor 155 (S14: No), the controller 130 determines that time ΔT2 is equal to or more than time T2 (S15). Time AT2 is a time taken up to the current time after the time when the low level signal is received from the installation sensor 154. When determining that time ΔT2 does not reach time T2 (S15: No), the controller 130 performs S14. When determining that time ΔT2 reaches time T2 (S15: Yes), the controller 130 displays a screen in the display 17 indicating the fact that there is an error in the maintenance process (S16), and ends the control. For example, time T2 is set in advance as a time longer than time T1 described below.

When the low level signal is received from the liquid level sensor 155 (S14: Yes), the controller 130 determines whether time ΔT1 is equal to or more than time T1 (S17). Time AT1 is a time from the time when the low level signal is received from the installation sensor 154 (S10: Yes) up to the time when the low level signal is received from the liquid level sensor 155 (S14: Yes). When determining that time ΔT1 is less than time T1 (S17: No), the controller 130 starts the maintenance process (S18). In other words, an absorption operation is started through the nozzle 29 of the head 21. Time AT1 is an example of a first elapsed time and a second elapsed time.

When determining that time ΔT1 is equal to or more than time T1 (S17: Yes), the controller 130 waits for time Tw1 (S19), and starts the maintenance process (S18). The waiting for time Tw1 is an example of the second elapsed time reaching the second time. For example, time T1 is set in advance as a time that is longer than the time from when the cartridge 200 storing the initial ink amount Vc0 of the ink in the liquid chamber 210 is installed in the installation case 150 so that the ink is discharged from the liquid chamber 210 to the empty liquid chamber 171 until the liquid level of the liquid chamber 171 becomes the predetermined position P.

When time ΔT1 is equal to or more than time T1, it is estimated that the speed (flow rate Qc) of the ink flowing from the liquid chamber 210 of the cartridge 200 to the liquid chamber 171 of the tank 160 is delayed due to a factor such as a discharging failure, and there needs a long time rather than the normal. Therefore, the flow rate Qc of the ink to the liquid chamber 171 after the maintenance process starts is reduced rather than the normal. In such a state, a sufficient amount of ink is stored in the liquid chamber 171 by waiting further for time Tw1 after the liquid level of the liquid chamber 171 reaches the predetermined position P. Thereafter, even if the maintenance process is performed at the predetermined flow rate Qp, it is possible to suppress that the liquid level of the liquid chamber 171 reaches nearly directly above the outlet 174. In the designing stage of the printer 10, in a case where the cartridge 200 in which the ink of the initial ink amount Vc0 is stored in the liquid chamber 210 is installed in the reference environment (temperature, humidity, etc.), a speed (the flow rate Qc) of the ink flowing from the liquid chamber of the cartridge 200 to the liquid chamber 171 of the tank 160 and a speed (the flow rate Qp) of the ink flowing from the liquid chamber 171 to the tank 160 by the maintenance process are designed to satisfy the following relation. In other words, the maintenance process is set such that the flow rate Qc after the liquid level sensor 155 outputs the low level signal becomes faster than the flow rate Qp after the liquid level sensor 155 outputs the low level signal.

The controller 130 determines whether the high level signal is received from the liquid level sensor 155 after the maintenance process starts (S20). When determining that the high level signal is not received from the liquid level sensor 155 (S20: No), and the maintenance process ends (S21: Yes), the controller 130 ends the control including the maintenance process.

When determining that the high level signal is received from the liquid level sensor 155 after the maintenance process starts (S20: Yes), the controller 130 stops the maintenance process (S22). In S22, the controller 130 stores the time when the high level signal is received from the liquid level sensor 155 in the RAM 133. The controller 130 determines whether the low level signal is received from the liquid level sensor 155 (S23).

The ink flows from the liquid chamber 171 to the tube 32 and the head 21 by the maintenance process. On the other hand, the ink flows from the liquid chamber 210 of the cartridge 200 to the liquid chamber 171. When the flow rate Qp of the ink flowing from the liquid chamber 171 is larger than the flow rate Qc of the ink flowing to the liquid chamber 171, the liquid level of the liquid chamber 171 may become lowered to be less than the predetermined position P. When the liquid level of the liquid chamber 171 becomes less than the predetermined position P, the liquid level sensor 155 outputs the high level signal to the controller 130. When the flow rate Qp of the ink flowing from the liquid chamber 171 is kept being larger than the flow rate Qc of the ink flowing to the liquid chamber 171, the liquid level of the liquid chamber 171 may reach nearly directly above the outlet 174. Then, when the high level signal is received after the maintenance process starts (S20: Yes), the controller 130 stops the maintenance process temporally. The liquid level of the ink in the liquid chamber 171 rises during a period when the maintenance process is stopped temporally. With this configuration, it is possible to suppress that the liquid level of the ink in the liquid chamber 171 is lowered down near to the outlet 174 by keeping the maintenance process.

When the low level signal is received from the liquid level sensor 155 (S23: Yes), the controller 130 waits for time Tw2 (an example of the second time) (S24), and restarts the stopping maintenance process (S25). When the maintenance process starts, the liquid level of the liquid chamber 171 reaches the predetermined position P and time Tw2 elapses further due to the state that the liquid level of the ink in the liquid chamber 171 is lowered, so that a sufficient amount of ink can be stored in the liquid chamber 171. The controller 130 performs S20.

When determining that the low level signal is not received from the liquid level sensor 155 (S23: No), the controller 130 determines whether time ΔT3 reaches time T3 (an example of the third time) (S26). Time AT3 is a time from the time when the high level signal is received from the installation sensor 154 (S19: the time of Yes) up to the current time (the time for performing the process of S26). When determining that time ΔT3 does not reach time T3 (S26: No), the controller 130 performs S23. When determining that time ΔT3 reaches time T3 (S26: Yes), the controller 130 displays a screen in the display 17 indicating the fact that there is an error in the maintenance process (S27), and ends the control including the maintenance process. For example, time T3 is set in advance as a time longer than time T1 described below.

According to the first illustrative embodiment, the controller 130 does not perform the maintenance process until the low level signal is received from the liquid level sensor 155 when the maintenance process is accepted before the low level signal is received from the liquid level sensor 155 after the cartridge 200 is installed in the installation case 150. With this configuration, the air does not enter the tube 32 and the head 21 from the liquid chamber 171, so that a time taken until the controller 130 accepts and performs the maintenance process can be shortened.

When the liquid level of the ink of the liquid chamber 171 is less than the predetermined position P during a period when the controller 130 performs the maintenance process, the controller 130 stops the maintenance process temporally due to a factor that the ink flow from the liquid chamber 210 to the liquid chamber 171 is not good. With this configuration, the air is suppressed from entering the liquid chamber 171 to the tube 32 and the head 21.

When the flow rate Qc of the ink from the liquid chamber 210 to the liquid chamber 171 is small, the controller 130 waits for time Tw1 after the cartridge 200 is installed in the installation case 150 and the maintenance process is accepted. With this configuration, the timing of starting the maintenance process is delayed further than that when the controller 130 receives the low level signal from the liquid level sensor 155. With this configuration, the air is suppressed from entering the liquid chamber 171 to the tube 32 and the head 21.

When the flow rate Qc of the ink from the liquid chamber 210 to the liquid chamber 171 is reduced still more, the controller 130 notifies the user through the display 17 of the fact that there is an abnormality in the flowing of the ink from the liquid chamber 210 to the liquid chamber 171.

Second Illustrative Embodiment

Hereinbelow, the second illustrative embodiment will be described. The printer according to the second illustrative embodiment does not include the liquid level sensor 155 in the printer 10 according to the first illustrative embodiment, but includes a temperature sensor (assuming that the liquid level sensor 155 is replaced with the temperature sensor in FIG. 7). The temperature sensor outputs to the controller 130 an electric signal corresponding to an ambient temperature to which the printer is set. In the EEPROM 134, a threshold C0 and times T4 and T5 set as a waiting time Tk are stored with respect to a predetermined temperature. In the second illustrative embodiment, when the maintenance process is accepted after the cartridge 200 is exchanged, a control different from the first illustrative embodiment is performed. The other configurations of the printer are similar to those of the printer 10 according to the first illustrative embodiment, and the description thereof will be omitted.

Similarly to the first illustrative embodiment, when all the ink of the liquid chamber 210 of the cartridge 200 installed in the installation case 150 of the printer 10 is consumed, and the cartridge 200 is pulled out of the installation case 150, the controller 130 performs the following control.

Figure 10:
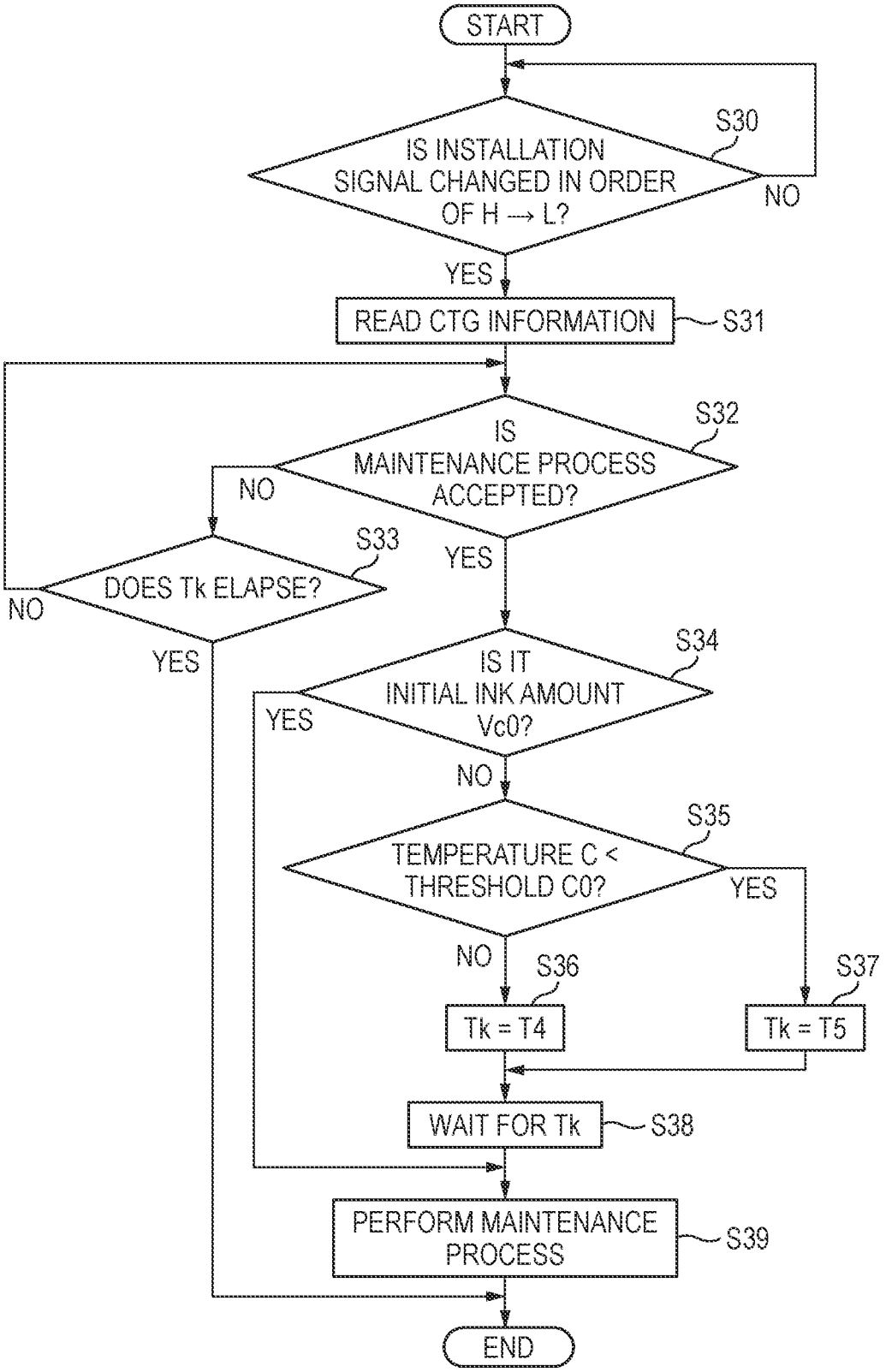
FIG. 10 is a flowchart of a maintenance process of a second illustrative embodiment.

As illustrated in FIG. 10, the controller 130 determines whether the high level signal is received from the installation sensor 154, and the low level signal is received from the installation sensor 154 (S30). When the controller 130 receives the low level signal from the installation sensor 154, the cartridge 200 is installed in the installation case 150. When the controller 130 receives the high level signal from the installation sensor 154, the cartridge 200 is not installed in the installation case 150.

Next, the controller 130 reads the CTG information such as the identification information and the ink amount Vc from the memory of the IC substrate 247 of the cartridge 200 installed in the installation case 150 (S31). The controller 130 stores the read CTG information in the EEPROM 134.

The controller 130 determines whether the execution of the maintenance process is input to the operation panel 22 (S32). When determining that the execution of the maintenance process is not input (S32: No), the controller 130 determines whether the waiting time Tk elapses after the low level signal is received from the installation sensor 154 (S33). When determining that the waiting time Tk does not elapse (S33: No), the controller 130 performs S32. When determining that the waiting time Tk elapses (S33: Yes), the controller 130 ends the control.

When determining that the execution of the maintenance process is input to the operation panel 22 (S32: Yes), the controller 130 determines whether the initial ink amount Vc0 is read from the memory of the IC substrate 247 as the ink amount Vc (S34). In the memory of the IC substrate 247 of the new cartridge 200, the initial ink amount Vc0 is stored as the ink amount Vc. When the cartridge 200 is used, for example, when the ink is discharged through the head 21 in the image recording to the maintenance process after the cartridge 200 is installed in the installation case 150, the controller 130 updates the ink amount Vc stored in the memory of the IC substrate 247. Therefore, the cartridge 200 from which the controller 130 reads the initial ink amount Vc0 as the ink amount stored in the memory of the IC substrate 247 is a new cartridge. A value or information such as a flag indicating a new cartridge may be stored instead of the ink amount Vc in the memory of the IC substrate 247. In this case, the controller 130 may determine whether the cartridge is new or not by reading the value or the information stored in the memory of the IC substrate 247. The initial ink amount Vc0 is an example of a cartridge threshold.

When determining that the ink amount Vc stored in the memory of the IC substrate 247 is the initial ink amount Vc0 (S34: Yes), the controller 130 performs the maintenance process (S39). When the new cartridge 200 is installed in the installation case 150, the ink flows from the liquid chamber 210 to the liquid chamber 171. The flow rate Qc at that moment shows a maximum water head difference which is a difference between the liquid level of the liquid chamber 171 of the tank 160 and the liquid level of the liquid chamber 210 of the cartridge 200. Therefore, the flow rate is fastest in the similar type of the cartridge 200. The reason will be described below.

The initial ink amount Vc0 is an ink amount which can set at the time of manufacturing the cartridge 200, and can be normalized within a predetermined range. Therefore, the flow rate Qc can also fall within the predetermined range. In other words, in the new cartridge 200, the flow rate Qc is set to be larger than the flow rate Qp of the ink flowing from the liquid chamber 171 in the maintenance process. With this configuration, when the new cartridge 200 is installed in the installation case 150, and the ink moves from the liquid chamber 210 to the liquid chamber 171, the liquid level of the ink of the liquid chamber 171 can be made not to be lowered even when the maintenance process is performed.

On the other hand, it is assumed that a used cartridge 200 of which the ink amount Vc stored in the liquid chamber 210 is less than the initial ink amount Vc0 is installed in the installation case 150 instead of the new cartridge 200. The water head difference between the liquid chamber 210 and the liquid chamber 171 when the used cartridge 200 is installed in the installation case 150 is smaller than the water head difference between the liquid chamber 210 and the liquid chamber 171 when the new cartridge 200 is installed. As the water head difference is reduced, the flow rate Qc is reduced. As a result, there is a concern that the flow rate Qc is smaller than the flow rate Qp of the ink flowing from the liquid chamber 171 in the maintenance process. If the flow rate Qc is smaller than the flow rate Qp, the liquid level of the liquid chamber 171 is lowered during the maintenance process, and reaches nearly directly above the outlet 174. Therefore, when the used cartridge 200 is installed in the installation case 150, the controller 130 is not performed rightly even when the maintenance process is accepted.

When the ink amount Vc read from the memory of the IC substrate 247 is not the initial ink amount Vc0 (S34: No), the controller 130 determines whether the temperature output by the temperature sensor is less than the threshold C0 (S35). When the temperature output by the temperature sensor is equal to or more that the threshold C0 (S35: No), the controller 130 sets time T4 to the waiting time Tk (S36). On the other hand, when the temperature output from the temperature sensor is less than the threshold C0 (S35: Yes), the controller 130 sets time T5 to the waiting time Tk. Time T5 is longer than time T4.

If the ambient temperature where the printer 10 is installed is lowered, it is also presumed that the temperature of the ink stored in the cartridge 200 installed in the installation case 150 is also low. The ink is increased in viscosity as the temperature is lowered Therefore, the flow rate Qc of the ink from the liquid chamber 210 to the liquid chamber 171 tends to be lowered as the ambient temperature is lowered. Thus, if the temperature C is less than the threshold C0, the controller 130 sets time T5, which is longer than time T4, as the waiting time Tk.

The controller 130 waits for the waiting time Tk (S38), and performs the maintenance process (S39). The ink flows from the liquid chamber 210 of the cartridge 200 to the liquid chamber 171 of the tank 160 during a period of waiting for the waiting time Tk, and the liquid level of the ink stored in the liquid chamber 171 rises. The liquid level of the ink stored in the liquid chamber 171 becomes high as the waiting time Tk becomes long. In other words, it is suppressed a concern that the liquid level of the ink reaches directly above the outlet 174 even if the liquid level of the ink of the liquid chamber 171 is lowered during the maintenance process.

According to the second illustrative embodiment, when the execution of the maintenance process is accepted after the cartridge 200 is installed in the installation case 150, the controller 130 reads the ink amount Vc stored in the memory of the IC substrate 247. When the read ink amount Vc is not the initial ink amount Vc0, the controller 130 performs the maintenance process after the waiting time Tk elapses. With this configuration, it is possible to shorten the time taken until the maintenance process is performed without causing the air to enter the tube 32 from the liquid chamber 171. On the other hand, when the cartridge 200 storing the ink of the initial ink amount Vc0 is installed in the installation case 150, and the maintenance process is accepted, the controller 130 performs immediately the maintenance process without waiting the waiting time Tk.

The flow rate Qc from the liquid chamber 210 to the liquid chamber 171 becomes small since the ambient temperature where the printer 10 is installed is low and the viscosity of the ink is high. When the ambient temperature is less than a threshold, the controller 130 sets time T5, which is longer than time T4, as the waiting time Tk until the maintenance process is performed after the cartridge 200 is installed in the installation case 150. Therefore, the timing of performing the maintenance process is delayed. With this configuration, it is suppressed that the air enters the tube 32 from the liquid chamber 171 in the maintenance process.

Modification to Second Illustrative Embodiment

In the second illustrative embodiment, when the ink amount Vc read from the memory of the IC substrate 247 is not the initial ink amount Vc0, the controller 130 may determine the waiting time Tk to be longer in an inverse proportion to the value of the read ink amount Vc. In other words, the waiting time Tk is short as the ink amount in the liquid chamber 210 of the cartridge 200 is large. The waiting time Tk becomes long as the ink amount in the liquid chamber 210 is small. For example, the controller 130 determines time Tk on the basis of a table or a function in which times T4 and T5 become long in an inverse proportion to the ink amount Vc.

In the second illustrative embodiment, the determination (S34) on whether the ink amount Vc read from the memory of the IC substrate 247 is the initial ink amount Vc0 may be omitted. In other words, the controller 130 waits for the waiting time Tk after the cartridge 200 is exchanged regardless of the value of the ink amount Vc read from the IC substrate 247, and may perform the maintenance process.

Third Illustrative Embodiment

Hereinbelow, the third illustrative embodiment will be described. The printer according to the third illustrative embodiment does not include the liquid level sensor 155 similarly to the printer according to the second illustrative embodiment. In the EEPROM 134, as thresholds, there are stored the flow rate Qp (an example of a flow rate threshold), the execution of the maintenance process time Tp, a tank threshold Vth1 (an example of a first tank threshold), a threshold Vth2 (an example of a total amount threshold), and a function or a table indicating a relation between the ink amount Vc and the flow rate Qc. In the third illustrative embodiment, when the maintenance process is accepted after the cartridge 200 is exchanged, a control different from the first illustrative embodiment and the second illustrative embodiment is performed. The other configurations of the printer are similar to those of the printer 10 according to the first illustrative embodiment, and the description thereof will be omitted.

Similarly to the first illustrative embodiment, when the execution of the maintenance process is accepted from the user after all the ink of the liquid chamber 210 of the cartridge 200 installed in the installation case 150 of the printer 10 is consumed and the cartridge 200 is pulled out of the installation case 150, the controller 130 performs the following control.

Figure 11A:
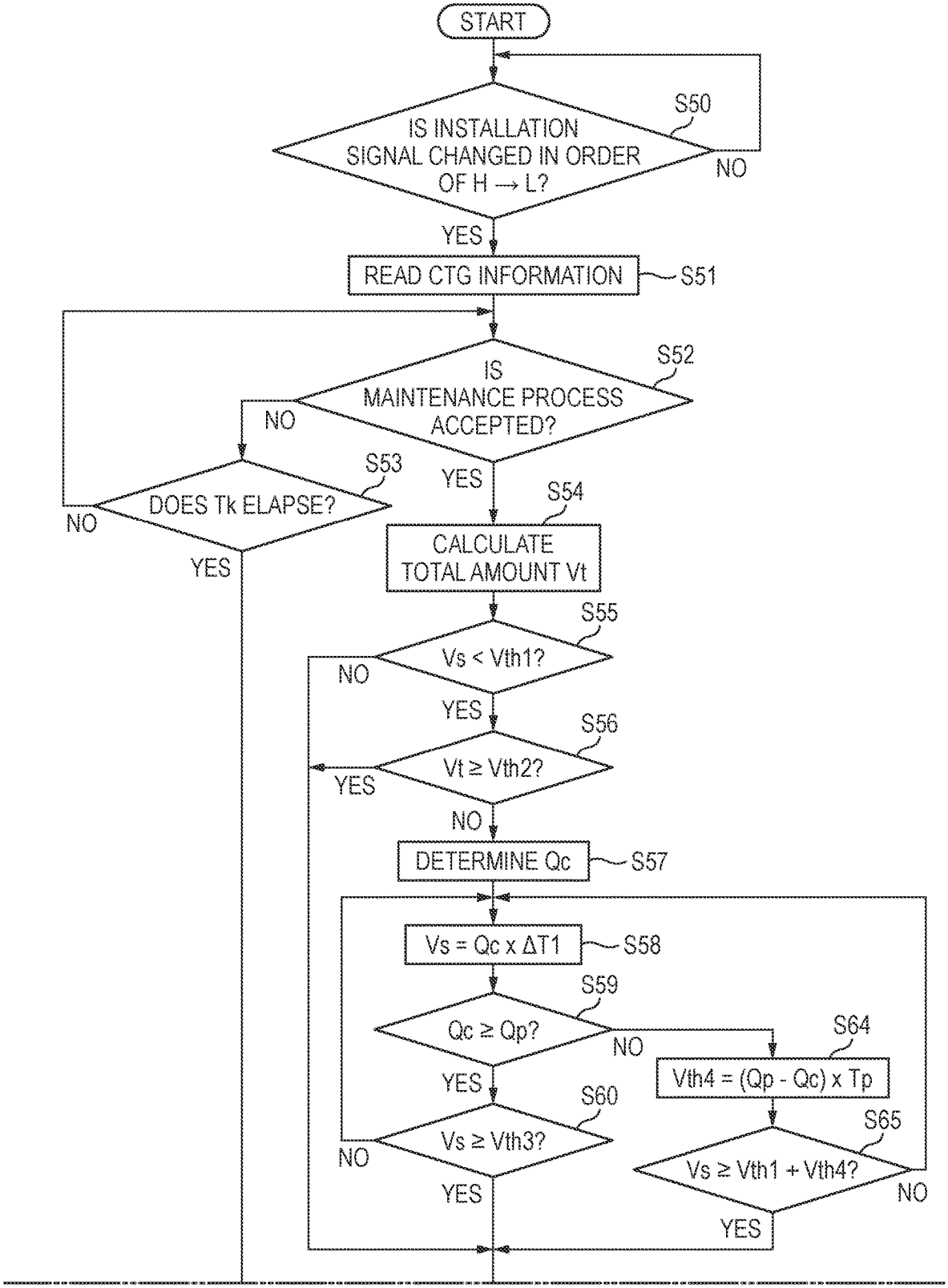
FIGS. 11A and 11B illustrate a flowchart of a maintenance process of a third illustrative embodiment.
Figure 11B:
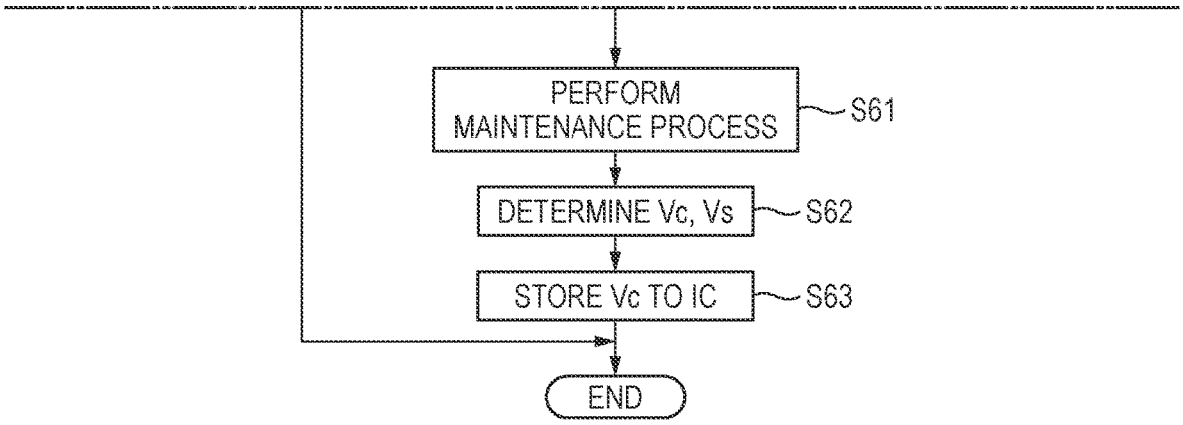

As illustrated in FIGS. 11A and 11B, the controller 130 determines whether the high level signal is received from the installation sensor 154, and the low level signal is received from the installation sensor 154 (S50). When the high level signal is received from the installation sensor 154, and the low level signal is received from the installation sensor 154 (S50: Yes), the controller 130 stores the time in the EEPROM 134. The time is actually a time at a point when the cartridge 200 is installed in the installation case 150. When the controller 130 receives the low level signal from the installation sensor 154, the cartridge 200 is installed in the installation case 150. When the controller 130 receives the high level signal from the installation sensor 154, the cartridge 200 is not installed in the installation case 150.

Subsequently, the controller 130 reads the CTG information such as the identification information and the ink amount Vc from the memory of the IC substrate 247 of the cartridge 200 installed in the installation case 150 (S51). The controller 130 stores the read CTG information in the EEPROM 134.

The controller 130 determines whether the execution of the maintenance process is input to the operation panel 22 (S52). When determining that the execution of the maintenance process is not input (S52: No), the controller 130 receives the low level signal from the installation sensor 154, and determines whether the waiting time Tk elapses (S53). When determining that the waiting time Tk does not elapse (S53: No), the controller 130 performs S52. When determining that the waiting time Tk elapses (S53: Yes), the controller 130 ends the control including the maintenance process. Herein, for example, the waiting time Tk is set in advance as a sufficient time such that the liquid level of the ink of the liquid chamber 210 and the liquid level of the ink of the liquid chamber 171 become the same height after the cartridge 200 is installed in the installation case 150.

When determining that the execution of the maintenance process is input to the operation panel 22 (S52: Yes), the controller 130 calculates the total amount Vt on the basis of the ink amount Vc read from the memory of the IC substrate 247 and the ink amount Vs stored in the EEPROM 134 as the ink amount Vs of the liquid chamber 171 before the cartridge 200 is exchanged (Vt=Vc+Vs: S54).

Next, the controller 130 determines whether the ink amount Vs of the liquid chamber 171 before the cartridge 200 is exchanged is less than the tank threshold Vth1 (S55). For example, the tank threshold Vth1 is a value corresponding to the ink amount stored in the liquid chamber 171 or a maximum ink amount required for the maintenance process when all the ink stored in the cartridge 200 installed in the installation case 150 is consumed. With this configuration, after the maintenance process ends, the controller determines whether the liquid level of the ink of the liquid chamber 171 is lowered to reach nearly directly above the outlet 174. When determining that the ink amount Vs of the liquid chamber 171 before the cartridge 200 is exchanged is not less than the tank threshold Vth1 (S55: No), the controller 130 starts the accepted maintenance process (S61).

When determining that the ink amount Vs of the liquid chamber 171 before the cartridge 200 is exchanged is less than the tank threshold Vth1 (S55: Yes), the controller 130 determines whether the calculated total amount Vt is equal to or more than the total amount threshold Vth2 (S56). For example, the total amount threshold Vth2 is set to a value such that the flow rate Qc of the ink flow from the liquid chamber 210 of the cartridge 200 to the liquid chamber 171 of the tank 160 does not become smaller than the flow rate Qp of the ink flowing from the liquid chamber 171 in the maintenance process. When determining that the calculated total amount Vt is equal to or more than the total amount threshold Vth2 (S56: Yes), the controller 130 starts the accepted maintenance process (S61).

When determining that the calculated total amount Vt is less than the total amount threshold Vth2 (S56: No), the controller 130 determines the flow rate Qc from the ink amount Vc included in the CTG information (S57). The flow rate Qc of the ink from the liquid chamber 210 to the liquid chamber 171 after the cartridge 200 is installed in the installation case 150 varies according to a difference between the height of the liquid level of the liquid chamber 210 from a reference position (for example, the predetermined position P) and the height of the liquid level of the liquid chamber 171 (that is, the water head difference).

For example, when the cartridge 200 is exchanged after all the ink stored in the cartridge 200 is consumed, the flow rate Qc depends on the height (that is, the ink amount Vc) of the liquid level of the liquid chamber 210 until the liquid level of the liquid chamber 171 of the tank 160 reaches the predetermined position P. Therefore, if the function or the table indicating the relation between the ink amount Vc and the flow rate Qc is stored in the EEPROM 134, the flow rate Qc can be determined on the basis of the ink amount Vc read from the memory of the IC substrate 247.

Next, the controller 130 multiplies the determined flow rate Qc and time ΔT1 from the time when the lower level signal is received from the installation sensor 154 up to the current time, and calculates the ink amount Vs stored in the liquid chamber 171 (S58). When the flow rate Qc is equal to or more than the flow rate Qp (threshold) (S59: Yes), the controller 130 determines whether the calculated ink amount Vs is equal to or more than a threshold Vth3 (S60).

When determining that the calculated ink amount Vs is less than the threshold Vth3 (S60: No), the controller 130 repeatedly performs S58 to S60 in a predetermined time interval. Since the calculated ink amount Vs becomes large as the current time passes, the calculated ink amount becomes equal to or more than the threshold Vth3 (S60: Yes). When determining that the ink amount Vs is equal to or more than the threshold Vth3 (S60: Yes), the controller 130 starts the maintenance process (S61).

After the maintenance process ends, the controller 130 calculates the ink amounts Vc and Vs after the maintenance process to store the ink amounts in the EEPROM 134 (S62). The calculated ink amount Vc is stored in the memory of the IC substrate 247 (S63), and the control including the maintenance process ends.

When determining in S59 that the flow rate Qc is less than the flow rate Qp (S59: No), the controller 130 calculates a threshold Vth4 (S64). The threshold Vth4 is calculated as a value obtained by multiplying time Tp to perform the maintenance process by the difference between the flow rate Qp and the flow rate Qc. If the flow rate Qc is less than the flow rate Qp, the ink in the liquid chamber 171 is reduced during a period when the maintenance process is performed. The difference between the flow rate Qp and the flow rate Qc corresponds to the ink amount reduced from the liquid chamber 171 per unit time in the maintenance process. The value obtained by multiplying time Tp by the difference corresponds to the total amount of the ink amount reduced from the liquid chamber 171 in the maintenance process.

The controller 130 determines whether the calculated ink amount Vs is equal to or more than the sum (an example of a second tank threshold) of the threshold Vth1 and the threshold Vth4 (S65). When determining that the calculated ink amount Vs is less than the sum of the threshold Vth1 and the threshold Vth4 (S65: No), the controller 130 repeatedly perform S58 to S64 in a predetermined time interval. Since the calculated ink amount Vs becomes large as the current time passes, the ink amount becomes equal to or more than the sum of the tank threshold Vth1 and the threshold Vth4 (S65: Yes). When determining that the ink amount Vs is equal to or more than the sum of the threshold Vth1 and the threshold Vth4 (S65: Yes), the controller 130 starts the maintenance process (S61), and performs S62 and S63.

According to the third illustrative embodiment, the controller 130 accepts the maintenance process after the cartridge 200 is installed in the installation case 150. Then, the time until the maintenance process is performed can be shortened according to the calculated total amount Vt and the flow rate Qc. It is possible to suppress that the air enters the tube 32 and the head 21 from the liquid chamber 171 by the maintenance process.

Modification to Third Illustrative Embodiment

In the above-described illustrative embodiment, the controller 130 has been described to determine the flow rate Qc on the basis of the ink amount Vc read from the memory of the IC substrate 247 using the function or the table indicating the relation between the ink amount Vc and the flow rate Qc, but the disclosure is not limited thereto. For example, the printer 10 further includes the temperature sensor. The controller 130 may select a plurality of functions or tables according to the output of the temperature sensor. The plurality of functions or tables are set such that the flow rate Qc becomes small as the temperature sensed by the temperature sensor is low. With this configuration, the ambient temperature of the printer 10 is low, and the viscosity of the ink is high. Therefore, the flow rate Qc to be determined becomes small if the flow rate from the liquid chamber 210 to the liquid chamber 171 becomes small. Therefore, it is possible to suppress that the air enters from the liquid chamber 171 to the tube 32 and the head 21 by the maintenance process.

Other Modifications

In the above-described first illustrative embodiment, the controller 130 is configured to detect whether the detection portion 194 of the actuator 190 is located at the detection position on the basis of the signal output by the liquid level sensor 155. However, the configuration of the liquid level sensor 155 is not particularly limited as long as the liquid level of the ink in the liquid chamber 171 can be detected. For example, the controller 130 may be a sensor which optically detects the liquid level of the ink in the liquid chamber 171 using a prism having a reflectance changing according to whether the ink comes into contact with the rear wall 164 of the liquid chamber 171. The liquid level sensor 155 may be the electrode rod which is inserted in the liquid chamber 171.

The operations of the controller 130, such as receiving the low level signal from the installation sensor 154, then receiving the high level signal from the installation sensor 154, and then receiving the low level signal from the installation sensor 154 are example of the controller 130 determining that the cartridge is installed in the installation case 150. Another example of the controller 130 determining that the cartridge 200 is installed in the installation case 150 will be described below.

For example, the controller 130 receives the low level signal after the high level signal is received from the cover sensor 88. The controller 130 reads the identification information from the memory of the IC substrate 247, and compares the identification information with the identification information of the cartridge 200 stored in the EEPROM 134 before the exchanging. When determining that the identification information read from the memory of the IC substrate 247 and the identification information stored in the EEPROM 134 is different, the controller 130 may determine that an ink cartridge 30 is exchanged in the installation case 150. In other words, "the controller 130 reads the identification information from the memory of the IC substrate 247, and compares the identification information with the identification information of the cartridge 200 stored in the EEPROM 134 before the exchanging. As a result, it is determined that the identification information read from the memory of the IC substrate 247 and the identification information stored in the EEPROM 134 are different" is an example of the controller 130 determining that the cartridge 200 is installed in the installation case 150. In this case, as the time stored in S10, the controller 130 reads the identification information from the memory of the IC substrate 247 and compares the identification information with the identification information of the cartridge 200 stored in the EEPROM 134 before the exchanging, and stores the time at which the identification information read from the memory of the IC substrate 247 and the identification information stored in the EEPROM 134 are different in the EEPROM. Alternatively, the time at which the low level signal is received after the high level signal is received from the cover sensor 88 may be stored in the EEPROM in S15.

For example, the controller 130 receives the low level signal after the high level signal is received from the cover sensor 88. The controller 130 displays a confirmation screen in the display 17 to the user which shows whether a new cartridge 200 is installed in the installation case 150. The controller 130 displays the confirmation screen in the display 17, and on the other hand receives an input corresponding to the confirmation screen through the operation panel 22. When the received input corresponds to that a new cartridge 200 is installed in the installation case 150, the controller 130 may determine that the ink cartridge 30 of the installation case 150 is exchanged. In other words, "the controller 130 receives the low level signal after the high level signal is received from the cover sensor 88. The controller 130 displays a confirmation screen in the display 17 to the user which shows whether a new cartridge 200 is installed in the installation case 150. The controller 130 displays the confirmation screen in the display 17, and on the other hand receives an input corresponding to the confirmation screen through the operation panel 22. The received input corresponds to that a new cartridge 200 is installed in the installation case 150" is an example of the controller 130 determining that the cartridge 200 is installed in the installation case 150. In this case, the controller 130 stores a time at which an input corresponding to the confirmation screen is received through the operation panel 22 in the EEPROM as the time stored in S10.

In the illustrative embodiments described above, the description has been given about that the ink moves from the liquid chamber 210 of the cartridge 200 to the liquid chamber 171 of the tank 160 by the water head difference. However, the movement of the ink from the liquid chamber 210 to the liquid chamber 171 is not limited to that caused by the water head difference. For example, while the liquid chamber 171 of the tank 160 is opened to the air, the liquid chamber 210 of the cartridge 200 may be not opened to the air. In this case, the liquid chamber 210 and the liquid chamber 171 come to contact in a flow path and a gas path. Therefore, the gas and the liquid are exchanged between the liquid chamber 171 and the liquid chamber 210 by gravity, and the ink moves from the liquid chamber 210 to the liquid chamber 171.

In the above-described illustrative embodiments, the ink has been described as an example of liquid. However, the liquid may be, for example, a pretreatment liquid which is ejected to a sheet at the time of recording an image before using the ink, or may be water to clean the head 21.

As discussed above, the disclosure may provide at least the following illustrative, non-limiting embodiments.

(1) A liquid discharge device comprising: a tank comprising a second liquid chamber, the second liquid chamber being connectable to a cartridge, the cartridge comprising a first liquid chamber storing a liquid; a flow path, one side of the flow path communicated with the second liquid chamber, the other side of the flow path communicated with the first liquid chamber of the cartridge to be connected to the tank; a head communicated with the flow path; a liquid level sensor; and a controller configured to: discharge ink from the head based on a recording instruction; receive a first signal from the liquid level sensor in a case a position of a liquid level in the second liquid chamber is equal to or more than a predetermined position; receive a second signal from the liquid level sensor in a case the position of the liquid level in the second liquid chamber is less than the predetermined position after the ink is discharged from the head based on the recording instruction; after the second signal is received from the liquid level sensor, determine whether the cartridge is installed in an installation case; based on determining that the cartridge is installed in the installation case after receiving the second signal from the liquid level sensor, accept a maintenance process of discharging a liquid stored in the second liquid chamber from the head; and based on receiving the first signal from the liquid level sensor, perform the accepted maintenance process.

According to the configuration, when the maintenance process is accepted before the first signal is received from the liquid level sensor after the cartridge is installed in the installation case, the maintenance process is not performed until the first signal is received from the liquid level sensor. With this configuration, it is possible to shorten a time taken until the maintenance process is accepted without the air entering from the second liquid chamber toward the head.

(2) The liquid discharge device of (1), wherein the controller is configured to: in a case the second signal is received from the liquid level sensor during a period where the maintenance process is performed, stop the maintenance process; and in a case the first signal is received from the liquid level sensor during a period where the performing of the maintenance process is stopped, resume the maintenance process.

According to the configuration, the maintenance process is stopped when the liquid level of the second liquid chamber is less than the predetermined position during the maintenance process due to a bad flow of the liquid from the first liquid chamber to the second liquid chamber. Therefore, it is suppressed that the air enters from the second liquid chamber toward the head.

(3) The liquid discharge device of (1) or (2), wherein the controller is configured to: in a case a first elapsed time reaches a first time, not to perform the maintenance process, the first elapsed time being from a time when the cartridge is installed in the installation case until a time when the first signal is received from the liquid level sensor; and in a case a second elapsed time reaches a second time, perform the maintenance process, the second elapsed time being elapsed time after receiving the first signal from the liquid level sensor.

According to the configuration, when the flow rate of the liquid from the first liquid chamber to the second liquid chamber is small, the timing of starting the maintenance process after the cartridge is installed in the installation case and the maintenance process is accepted can be made later than the time when the first signal is received from the liquid level sensor. With this configuration, it is suppressed that the air enters from the second liquid chamber toward the head.

(4) The liquid discharge device of (3), further comprising: an alarm, wherein the controller is configured to, in a case a third elapsed time reaches a third time and the second signal is received from the liquid level sensor without receiving the first signal, activate the alarm, the third elapsed time being elapsed time after determining that the cartridge is installed in the installation case, the third time being longer than the first time.

According to the configuration, when the flow rate of the liquid from the first liquid chamber to the second liquid chamber is smaller, an abnormality in the liquid flowing from the first liquid chamber to the second liquid chamber is notified to the user.

(5) A liquid discharge device comprising: a tank comprising a second liquid chamber, the second liquid chamber being connectable to a cartridge, the cartridge comprising a first liquid chamber storing a liquid; a flow path, one side of the flow path communicated with the second liquid chamber, the other side of the flow path communicated with the first liquid chamber of the cartridge to be connected to the tank; a head communicated with the flow path; and a controller configured to: discharge ink from the head based on a recording instruction; determine whether the cartridge is installed in an installation case; after the ink is discharged from the head based on the recording instruction, accept a maintenance process of discharging a liquid stored in the second liquid chamber from the head, the maintenance process being accepted based on determining that the cartridge is installed in the installation case and before an elapsed time reaches a waiting time, accept the maintenance process, the elapsed time being from a time when determining that the cartridge is installed in the installation case; and in a case the elapsed time reaches the waiting time, perform the accepted maintenance process.

According to the configuration, when the maintenance process is accepted before a fourth time after the cartridge is installed in the installation case, the time taken until the maintenance process is performed after being accepted without the air entering from the second liquid chamber toward the head.

(6) The liquid discharge device of (5), further comprising: a temperature sensor, wherein the controller is configured to set the waiting time to be long as a temperature by a signal received from the temperature sensor is low.

According to the configuration, since the viscosity of the low-temperature liquid is high, the timing of performing the maintenance process after the cartridge is installed in the installation case and the maintenance process is accepted is delayed if the flow rate from the first liquid chamber to the second liquid chamber is not small. Therefore, it is suppressed that the air enters from the second liquid chamber toward the head.

(7) A liquid discharge device comprising: a tank comprising a second liquid chamber, the second liquid chamber being connectable to a cartridge, the cartridge comprising a first liquid chamber storing a liquid; a flow path, one side of the flow path communicated with the second liquid chamber, the other side of the flow path communicated with the first liquid chamber of the cartridge to be connected to the tank; a head communicated with the flow path; an interface; and a controller configured to: discharge ink from the head based on a recording instruction; determine whether the cartridge is installed in the installation case; after the ink is discharged from the head based on the recording instruction, accept a maintenance process of discharging a liquid stored in the second liquid chamber from the head; based on determining that the cartridge is installed in the installation case read a liquid amount Vc of the liquid stored in the first liquid chamber from a cartridge memory of the cartridge through the interface; in a case the read liquid amount Vc is less than a cartridge threshold and before an elapsed time reaches a waiting time, accept the maintenance process, the elapsed time being from a time when determining that the cartridge is installed in the installation case; and in a case the elapsed time reaches the waiting time, perform the accepted maintenance process.

According to the configuration, when the liquid amount Vc of the first liquid chamber of the cartridge installed in the installation case is less than the cartridge threshold and the maintenance process is accepted before the waiting time elapses, it is possible to suppress that the air enters from the second liquid chamber toward the head. It is possible to shorten the time taken until the maintenance process is accepted and performed. If the liquid amount Vc of the first liquid chamber of the cartridge installed in the installation case is equal to or more than the cartridge threshold, the maintenance process can be performed right away.

(8) The liquid discharge device of (7), wherein the controller is configured to determine the waiting time to be long in an inverse proportion to the liquid amount Vc on a condition that the liquid amount Vc is less than the cartridge threshold.

According to the configuration, the time taken until the maintenance process is accepted after the cartridge is installed in the installation case can be shortened according to the liquid amount Vc.

(9) A liquid discharge device comprising: a tank comprising a second liquid chamber, the second liquid chamber being connectable to a cartridge, the cartridge comprising a first liquid chamber storing a liquid; a flow path, one side of the flow path communicated with the second liquid chamber, the other side of the flow path communicated with the first liquid chamber of the cartridge to be connected to the tank; a head communicated with the flow path; an interface; and a controller configured to: discharge ink from the head based on a recording instruction; determine whether the cartridge is installed in the installation case; calculate a liquid amount Vs stored in the second liquid chamber; after the ink is discharged from the head based on the recording instruction, accept a maintenance process of discharging a liquid stored in the second liquid chamber from the head; based on determining that the cartridge is installed in the installation case, read a liquid amount Vc of the liquid stored in the first liquid chamber from a cartridge memory of the cartridge through the interface; and in a case the liquid amount Vs before the cartridge is installed in the installation case is less than a first tank threshold and a total amount Vt of the liquid amount Vs and the read liquid amount Vc is equal to or more than a total amount threshold, perform the accepted maintenance process.

According to the configuration, it is possible to shorten the time taken until the maintenance process is performed after the cartridge is installed in the installation case and the maintenance process is accepted.

(10) The liquid discharge device of (9), wherein the controller is configured to: based on the read liquid amount Vc, determine a flow rate Qc of the liquid flowing from the first liquid chamber to the second liquid chamber; calculate an updated liquid amount Vs by adding a liquid amount to the liquid amount Vs before the cartridge is installed in the installation case, the liquid amount being obtained by multiplying an elapsed time from a time when determining that the cartridge is installed in the installation case by the flow rate Qc; and in a case the total amount Vt is less than the total amount threshold and the updated liquid amount Vs is equal to or more than the first tank threshold, perform the maintenance process.

According to the configuration, it is possible to shorten the time taken until the maintenance process is performed after the cartridge is installed in the installation case to accept the maintenance process when the total amount is less than a total amount threshold.

(11) The liquid discharge device of (10), wherein the controller is configured to: on a condition that the flow rate Qc is less than a flow rate threshold, calculate a second tank threshold by adding the first tank threshold and a liquid amount Vth, the liquid amount Vth being obtained by multiplying a time when the maintenance process is performed to a difference between the flow rate threshold and the flow rate Qc; and in a case the updated liquid amount Vs is equal to or more than the second tank threshold, perform the maintenance process.

According to the configuration, it is possible to shorten the time taken until the maintenance process is performed after the cartridge is installed in the installation case and the maintenance process is accepted according to the flow rate Qc.

(12) The liquid discharge device of (10) or (11), further comprising: a temperature sensor, wherein the controller is configured to determine the flow rate Qc to be small as a temperature by a signal received from the temperature sensor is low.

According to the configuration, since the viscosity of the low-temperature liquid is high, the determined flow rate Qc also becomes small if the flow rate from the first liquid chamber to the second liquid chamber becomes small. Therefore, it is suppressed that the air enters from the second liquid chamber toward the head.

(13) The liquid discharge device of any one of (1) to (12), further comprising: a pump; and a cap connected to the pump, wherein the controller is configured to, in a case of performing the maintenance process, discharge a liquid from a nozzle of the head by driving the pump in a state where the cap covers the nozzle of the head.

According to the disclosure, it is possible to shorten a time taken until a maintenance process is performed after a cartridge is installed to an installation case and the maintenance process is accepted. Since the maintenance process is performed after the cartridge is installed in the installation case, it is possible to suppress that the air enters from a second liquid chamber toward a head.

What is claimed is:

1. A liquid discharge device comprising:

a tank comprising a second liquid chamber, the second liquid chamber being connectable to a cartridge, the cartridge comprising a first liquid chamber storing a liquid;

a flow path, one side of the flow path communicated with the second liquid chamber, the other side of the flow path communicated with the first liquid chamber of the cartridge to be connected to the tank;

a head communicated with the flow path; and a controller configured to:

discharge ink from the head based on a recording instruction;

determine whether the cartridge is installed in an installation case;

after the ink is discharged from the head based on the recording instruction, accept a maintenance process of discharging a liquid stored in the second liquid chamber from the head, the maintenance process being accepted based on determining that the cartridge is installed in the installation case and before an elapsed time reaches a waiting time, the elapsed time being from a time when determining that the cartridge is installed in the installation case; and in a case the elapsed time reaches the waiting time, perform the accepted maintenance process.

2. The liquid discharge device according to claim 1, further comprising:

a temperature sensor, wherein the controller is configured to set the waiting time to be long as a temperature by a signal received from the temperature sensor is low.

3. The liquid discharge device according to claim 1, further comprising:

a pump; and a cap connected to the pump, wherein the controller is configured to, in a case of performing the maintenance process, discharge a liquid from a nozzle of the head by driving the pump in a state where the cap covers the nozzle of the head.

4. A liquid discharge device comprising:

a tank comprising a second liquid chamber, the second liquid chamber being connectable to a cartridge, the cartridge comprising a first liquid chamber storing a liquid;

a flow path, one side of the flow path communicated with the second liquid chamber, the other side of the flow path communicated with the first liquid chamber of the cartridge to be connected to the tank;

a head communicated with the flow path;

an interface; and a controller configured to:

discharge ink from the head based on a recording instruction;

determine whether the cartridge is installed in the installation case;

after the ink is discharged from the head based on the recording instruction, accept a maintenance process of discharging a liquid stored in the second liquid chamber from the head;

based on determining that the cartridge is installed in the installation case, read a liquid amount Vc of the liquid stored in the first liquid chamber from a cartridge memory of the cartridge through the interface;

in a case the read liquid amount Vc is less than a cartridge threshold and before an elapsed time reaches a waiting time, accept the maintenance process, the elapsed time being from a time when determining that the cartridge is installed in the installation case; and in a case the elapsed time reaches the waiting time, perform the accepted maintenance process.

5. The liquid discharge device according to claim 4, wherein the controller is configured to determine the waiting time to be long in an inverse proportion to the liquid amount Vc on a condition that the liquid amount Vc is less than the cartridge threshold.

6. The liquid discharge device according to claim 4, further comprising:

a pump; and a cap connected to the pump, wherein the controller is configured to, in a case of performing the maintenance process, discharge a liquid from a nozzle of the head by driving the pump in a state where the cap covers the nozzle of the head.

7. A liquid discharge device comprising:

a tank comprising a second liquid chamber, the second liquid chamber being connectable to a cartridge, the cartridge comprising a first liquid chamber storing a liquid;

a flow path, one side of the flow path communicated with the second liquid chamber, the other side of the flow path communicated with the first liquid chamber of the cartridge to be connected to the tank;

a head communicated with the flow path;

an interface; and a controller configured to:

discharge ink from the head based on a recording instruction;

determine whether the cartridge is installed in the installation case;

calculate a liquid amount Vs stored in the second liquid chamber;

after the ink is discharged from the head based on the recording instruction, accept a maintenance process of discharging a liquid stored in the second liquid chamber from the head;

based on determining that the cartridge is installed in the installation case, read a liquid amount Vc of the liquid stored in the first liquid chamber from a cartridge memory of the cartridge through the interface; and in a case the liquid amount Vs before the cartridge is installed in the installation case is less than a first tank threshold and a total amount Vt of the liquid amount Vs and the read liquid amount Vc is equal to or more than a total amount threshold, perform the accepted maintenance process.

8. The liquid discharge device according to claim 7, wherein the controller is configured to:

based on the read liquid amount Vc, determine a flow rate Qc of the liquid flowing from the first liquid chamber to the second liquid chamber;

calculate an updated liquid amount Vs by adding a liquid amount to the liquid amount Vs before the cartridge is installed in the installation case, the liquid amount being obtained by multiplying an elapsed time from a time when determining that the cartridge is installed in the installation case by the flow rate Qc; and in a case the total amount Vt is less than the total amount threshold and the updated liquid amount Vs is equal to or more than the first tank threshold, perform the maintenance process.

9. The liquid discharge device according to claim 8, wherein the controller is configured to:

on a condition that the flow rate Qc is less than a flow rate threshold, calculate a second tank threshold by adding the first tank threshold and a liquid amount Vth, the liquid amount Vth being obtained by multiplying a time when the maintenance process is performed to a difference between the flow rate threshold and the flow rate Qc; and in a case the updated liquid amount Vs is equal to or more than the second tank threshold, perform the maintenance process.

10. The liquid discharge device according to claim 8, further comprising:

a temperature sensor, wherein the controller is configured to determine the flow rate Qc to be small as a temperature by a signal received from the temperature sensor is low.

11. The liquid discharge device according to claim 7, further comprising:

a pump; and a cap connected to the pump, wherein the controller is configured to, in a case of performing the maintenance process, discharge a liquid from a nozzle of the head by driving the pump in a state where the cap covers the nozzle of the head.

* * * * *